US009791814B2

(12) United States Patent
Endo et al.

(10) Patent No.: US 9,791,814 B2
(45) Date of Patent: Oct. 17, 2017

(54) IMAGE FORMING APPARATUS

(71) Applicant: CANON KABUSHIKI KAISHA, Tokyo (JP)

(72) Inventors: Terutaka Endo, Kawasaki (JP); Daisuke Yamamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/091,387

(22) Filed: Apr. 5, 2016

(65) Prior Publication Data

US 2016/0299459 A1 Oct. 13, 2016

(30) Foreign Application Priority Data

| | | |
|---|---|---|
| Apr. 9, 2015 | (JP) | 2015-080458 |
| Jun. 19, 2015 | (JP) | 2015-124152 |
| Jun. 19, 2015 | (JP) | 2015-124263 |
| Jun. 19, 2015 | (JP) | 2015-124264 |

(51) Int. Cl.
*G03G 15/00* (2006.01)
*G03G 15/23* (2006.01)

(52) U.S. Cl.
CPC ..... *G03G 15/234* (2013.01); *G03G 15/6567* (2013.01); *G03G 2215/00586* (2013.01)

(58) Field of Classification Search
CPC ..... G03G 15/234
USPC ..... 399/401
See application file for complete search history.

(56) References Cited

U.S. PATENT DOCUMENTS

| | | | | |
|---|---|---|---|---|
| 4,955,965 A * | 9/1990 | Mandel | B65H 5/062 271/184 |
| 5,683,078 A * | 11/1997 | Schieck | B65H 9/002 271/250 |
| 5,844,137 A * | 12/1998 | Carson | G01F 1/002 137/469 |
| 8,500,124 B1 * | 8/2013 | Reidhaar | B65H 29/58 271/186 |

(Continued)

FOREIGN PATENT DOCUMENTS

| | | |
|---|---|---|
| JP | 2000-272782 A | 10/2000 |
| JP | 2007-62960 A | 3/2007 |
| JP | 2009-149392 A | 7/2009 |

*Primary Examiner* — Anthony Nguyen
(74) *Attorney, Agent, or Firm* — Canon U.S.A., Inc. IP Division

(57) ABSTRACT

An image forming apparatus for forming an image on a sheet, includes an image forming unit configured to form the image on the sheet, a double-sided conveyance path through which the sheet with the image formed on a first surface passes before the image forming unit forms an image on a second surface opposite to the first surface, a guide member having a contact portion configured to contact one end of the sheet in the width direction of the sheet, the guide member being provided on the double-sided conveyance path, and a reversing roller pair forwardly and reversely rotatable, configured to convey the sheet to the double-sided conveyance path during a reverse rotation, the reversing roller pair having a drive shaft, and a first roller and a second roller coaxially disposed on the shaft, rotatable with the shaft, wherein the second roller is disposed at a position more away from the contact portion than the first roller in the axial direction of the shaft, the second roller having a larger outer diameter than the first roller.

11 Claims, 26 Drawing Sheets

(56) References Cited

U.S. PATENT DOCUMENTS

| | | | | |
|---|---|---|---|---|
| 8,657,282 | B2 * | 2/2014 | Hashimoto | B65H 85/00 271/186 |
| 2003/0143006 | A1 * | 7/2003 | Kirino | B42C 1/12 399/407 |
| 2008/0273908 | A1 * | 11/2008 | Ohkubo | G03G 15/6552 399/405 |
| 2009/0148214 | A1 * | 6/2009 | Gaman | G03G 15/6573 399/401 |
| 2011/0188913 | A1 * | 8/2011 | Aoi | G03G 15/23 399/388 |

* cited by examiner

IMAGE FORMING APPARATUS

BACKGROUND OF THE INVENTION

Field of the Invention

The present invention relates to an image forming apparatus having a mechanism for shifting a sheet with an image formed on one side in a direction perpendicular to the sheet conveyance direction when forming an image on the opposite surface of the sheet.

Description of the Related Art

Japanese Patent Application Laid-Open No. 2007-62960 discusses an image forming apparatus capable of double-sided printing, having a mechanism for shifting, in the direction perpendicular to the sheet conveyance direction, a sheet with an image printed on one side by switching back the sheet. As illustrated in FIG. 6, a sheet S picked up by a feed roller 901 is conveyed by a registration roller pair 902. A transfer roller 903 transfers a toner image onto one side of the sheet S, and then a fixing roller 904 fixes the toner image onto the sheet S.

In a case of double-sided image forming, after the trailing edge of the sheet S conveyed by a discharge reversing roller 905 passes through a point C, the discharge reversing roller 905 reversely rotates (reverses the rotational direction). Subsequently, the sheet S is shifted toward one side in the direction perpendicular to the sheet conveyance direction (i.e., in the width direction of the sheet S) by an oblique conveyance roller 906, and is abutted on a reference guide 910.

Thus, in a state where the positional accuracy of the sheet S in the width direction is guaranteed, the sheet S is conveyed by a re-feed roller 907, to the conveyance path for the first surface, and then is conveyed to the registration roller pair 902. Subsequently, after an image is formed on the back surface of the sheet S by the transfer roller 903 and the fixing roller 904, the sheet S is discharged onto a discharge tray 909 by the discharge reversing roller 905.

However, with the decrease in size of the image forming apparatus, the conveyance distance from the discharge reversing roller 905 to the re-feed roller 907 tends to decrease. Further, with the decrease in size of the image forming apparatus, the degree of the bending of the curved conveyance path tends to increase, and therefore, the frictional resistance between the sheet S and a conveyance guide increases. There has been a case where, as a result thereof, the sheet S cannot be shifted by a required amount by the oblique conveyance roller 906 to be conveyed along with the reference guide 910.

SUMMARY OF THE INVENTION

According to an aspect of the present invention, an image forming apparatus for forming an image on a sheet, includes an image forming unit configured to form the image on the sheet, a double-sided conveyance path through which the sheet with the image formed on a first surface passes before the image forming unit forms an image on a second surface opposite to the first surface, a guide member having a contact portion configured to contact one end of the sheet in the width direction of the sheet, the guide member being provided on the double-sided conveyance path, and a reversing roller pair forwardly and reversely rotatable, configured to convey the sheet to the double-sided conveyance path during a reverse rotation, the reversing roller pair having a drive shaft, and a first roller and a second roller coaxially disposed on the shaft, rotatable with the shaft, wherein the second roller is disposed at a position more away from the contact portion than the first roller in the axial direction of the shaft, the second roller having a larger outer diameter than the first roller.

According to another aspect of the present invention, an image forming apparatus for forming an image on a sheet, includes an image forming unit configured to form the image on the sheet, a double-sided conveyance path through which the sheet with the image formed on a first surface passes so that the image forming unit forms an image on a second surface opposite to the first surface, a guide member having a contact portion configured to contact one end of the sheet in the width direction of the sheet, the guide member being provided on the double-sided conveyance path, a first roller unit forwardly and reversely rotatable, the first roller unit having a drive shaft, and a first roller and a second roller coaxially disposed on the shaft, rotatable with the shaft, a second roller unit configured to form a first nip portion in cooperation with the first roller unit, a rotation center of the second roller unit being disposed perpendicularly below a rotation center of the first roller unit, and a third roller unit configured to form a second nip portion in cooperation with the first roller unit, a rotation center of the third roller unit being disposed perpendicularly above the rotation center of the first roller unit, wherein, while the first roller unit is forwardly rotating, the sheet is conveyed toward an outside of the apparatus at the first nip portion and conveyed toward the double-sided conveyance path at the second nip portion, and wherein the second roller is disposed at a position more away from the contact portion than the first roller in an axial direction of the shaft, the second roller having a larger outer diameter than the first roller.

Further features of the present invention will become apparent from the following description of exemplary embodiments with reference to the attached drawings.

DESCRIPTION OF THE EMBODIMENTS

Figure 4:
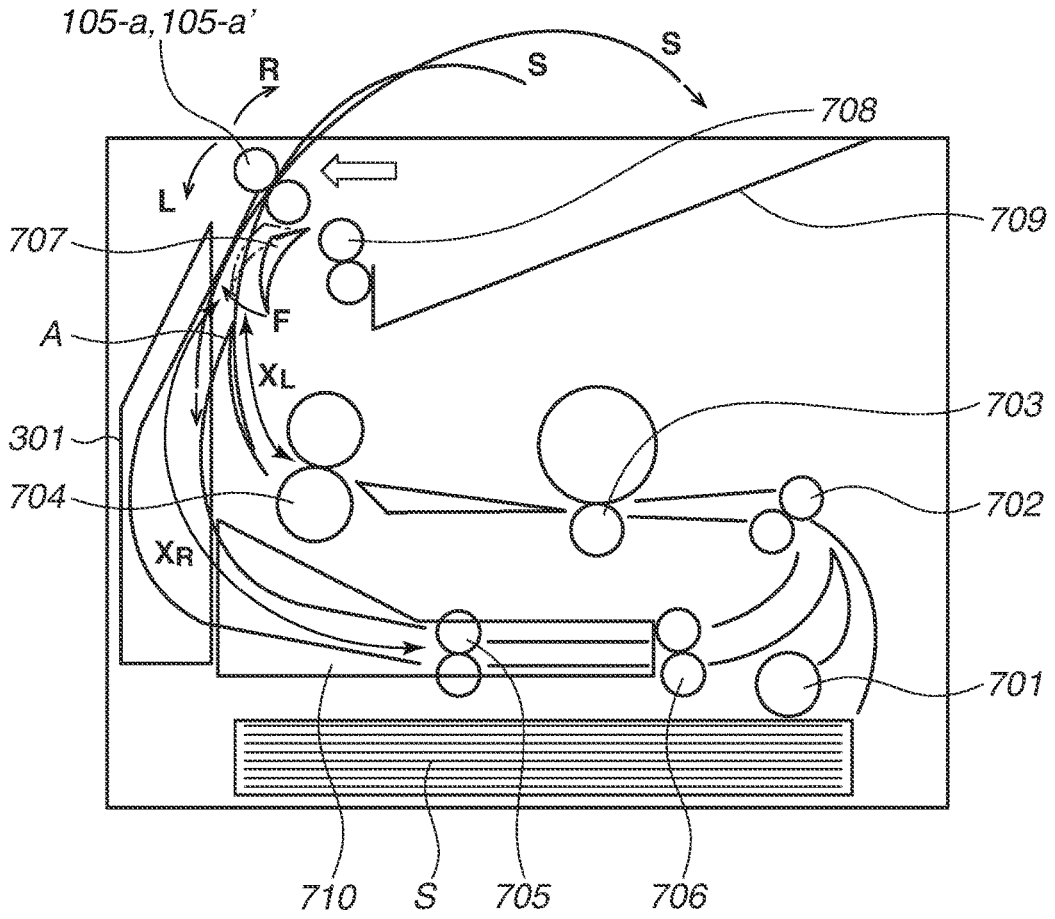
FIG. 4 is a schematic sectional view illustrating an image forming apparatus according to the first exemplary embodiment.

A first exemplary embodiment according to the present invention will be described below. First of all, the drawings relating to a configuration according to the first exemplary embodiment will be described below. FIG. 4 is a schematic sectional view illustrating an image forming apparatus according to the first exemplary embodiment. The right side of the drawing is the front side of the image forming apparatus, and the left side of the drawing is the rear side of the image forming apparatus.

Figure 1:
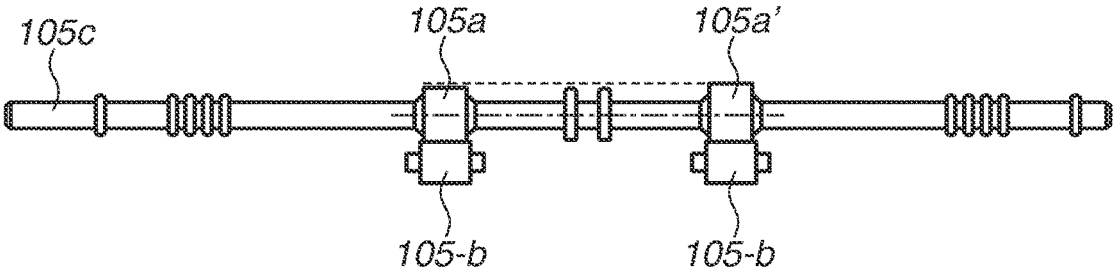
FIG. 1 illustrates reversing switchback roller pairs according to a first exemplary embodiment.
Figure 2:
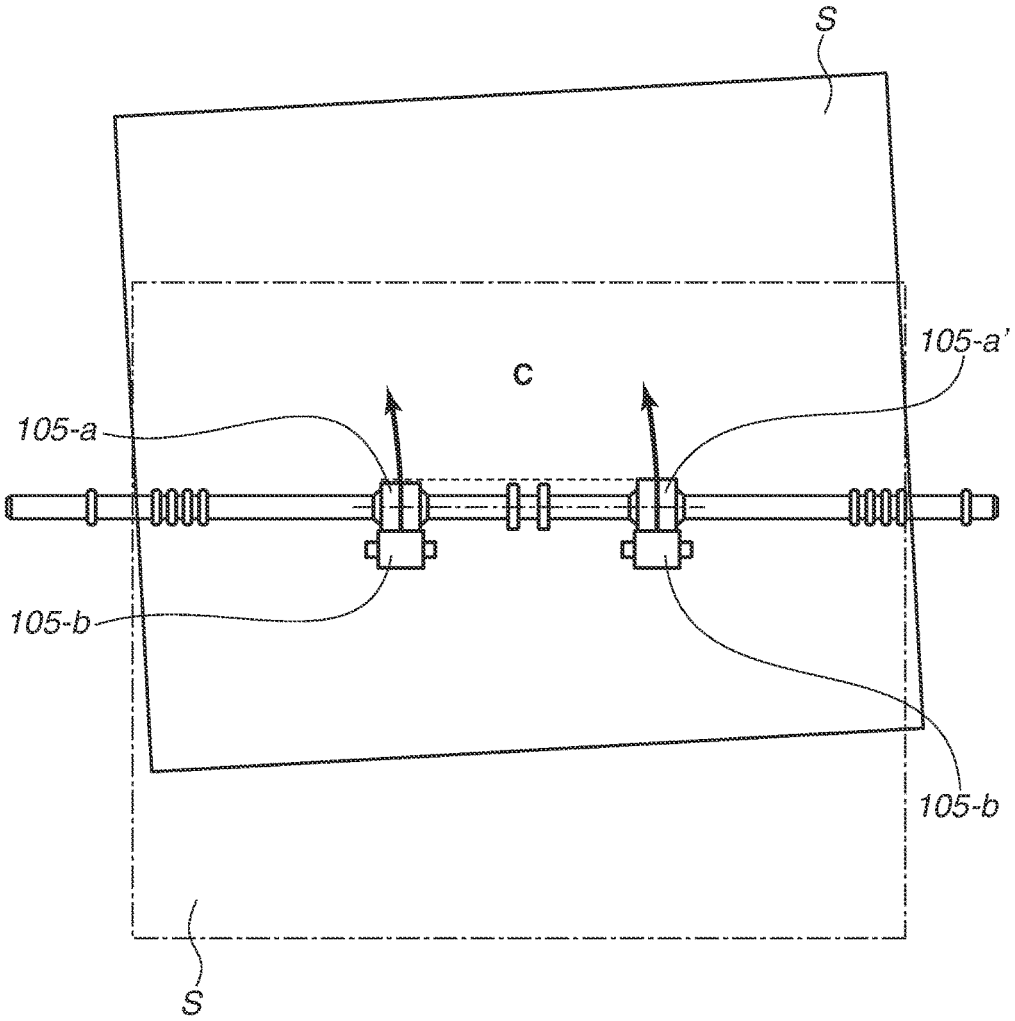
FIG. 2 illustrates a forward rotation of the reversing switchback rollers and a sheet conveyance direction according to the first exemplary embodiment.
Figure 3:
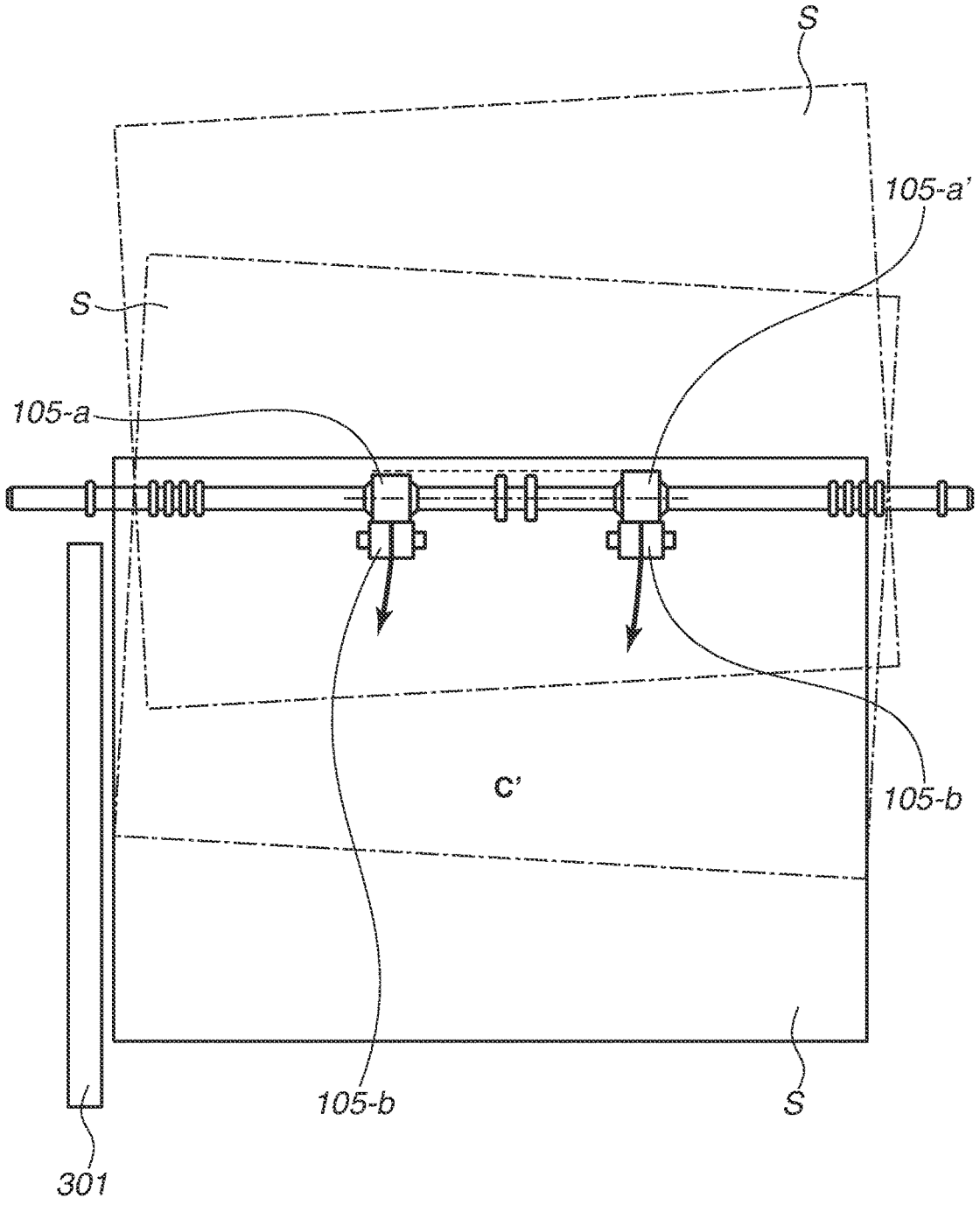
FIG. 3 illustrates a reverse rotation of the reversing switchback rollers and the sheet conveyance direction according to the first exemplary embodiment.

FIG. 1 illustrates a relation between reversing switchback rollers and facing rollers according to the first exemplary embodiment, viewed from the direction indicated by a thick arrow illustrated in FIG. 4. FIGS. 2 and 3 illustrate a relation between the reversing switchback rollers, facing rollers, and a sheet during sheet conveyance, viewed from the same direction as FIG. 1. FIG. 2 illustrates a state where the sheet is conveyed toward the outside of the image forming apparatus. FIG. 3 illustrates a state where the sheet is conveyed toward the inside of the image forming apparatus.

Operations since a sheet S is fed until it is discharged will be described below with reference to FIG. 4. First of all, the sheet S picked up by a feed roller 701 is conveyed by a registration roller pair 702. Then, a toner image is transferred onto one side of the sheet S by a transfer roller 703, and then heated and fixed onto the sheet S by a fixing roller 704. The direction perpendicular to the direction in which the sheet S is conveyed by the registration roller pair 702 is referred to as the width direction of the sheet S. The sheet width direction is identical to the axial direction of a photosensitive drum 703*a*. The registration roller pair 702 conveys the sheet S in synchronization with an image on the photosensitive drum (image bearing member) 703*a*.

Subsequently, the sheet S is conveyed by a reversing switchback roller 105-*a* (first drive roller) and a reversing switchback roller 105-*a*' (second drive roller) disposed on a drive shaft 105*c*. Then, after the sheet S passes the fixing roller 704 and the trailing edge of the sheet S passes through a point (branch point) A, the coaxially disposed reversing switchback rollers 105-*a* and 105-*a*' reverse the rotational direction from L (counterclockwise direction) to R (clockwise direction).

As illustrated in FIG. 1, the outer diameter of the switchback roller 105-*a*' is larger than the outer diameter of the switchback roller 105-*a*. Taking into consideration the damage to the sheet S due to an excessively large outer diameter difference between the two switchback rollers and conveyance failures such as jam during sheet conveyance, it is desirable that the ratio of the outer diameter of the switchback roller 105-*a*' to the outer diameter of the switchback roller 105-*a* is about 1.005 to 1.025. In other words, it is desirable that the outer diameter of switchback roller 105-*a*' is 1.005 to 1.025 times the outer diameter of the switchback roller 105-*a*. In the present exemplary embodiment, the outer diameter of switchback roller 105-*a* is Φ12, and the outer diameter of switchback roller 105-*a*' is Φ12.15. The switchback rollers 105-*a* and 105-*a*' are provided so that they are rotatable integrally with the drive shaft 105*c* rotatable in the forward direction (L direction) and in the reverse direction (R direction) while receiving a rotational driving force from a motor M (driving unit) that generates a driving force. Switchback driven rollers 105-*b*(first and second driven rollers) are driven by the rotation of the switchback rollers 105-*a* and 105-*a*'. In the first exemplary embodiment, the switchback rollers 105-*a* and 105-*a*' and the switchback driven rollers 105-*b* configure reversing roller pairs.

When the switchback rollers 105-*a* and 105-*a*' reversely rotate, the sheet S with an image formed on one side (first surface) is conveyed in a double-sided conveyance path. The sheet S that has passed through the double-sided conveyance path is conveyed again to an image forming unit (the transfer roller 703 and the photosensitive drum 703*a*), and an image is formed on the back surface (second surface on the opposite side of the first surface). A fixing unit includes the fixing roller 704 disposed between the image forming unit and the reversing roller pairs in the conveyance direction of the sheet S. In the first exemplary embodiment, the double-sided conveyance path is provided with an oblique conveyance roller pair 705 as a conveyance roller pair for conveying the sheet S toward the image forming unit. One roller of the oblique conveyance roller pair 705 is obliquely disposed in the direction for bringing the sheet S to contact a reference guide (guide member) 710. Therefore, the oblique conveyance roller pair 705 obliquely conveys the sheet S so that a side end of the sheet S (one end in the width direction of the sheet S) is brought into contact with the contacting portion (contact portion) of the reference guide (guide member) 710. Then, when the oblique conveyance roller pair 705 obliquely conveys the sheet S with respect to the sheet conveyance direction, the sheet S is conveyed toward the image forming unit with one side end of the sheet S contacting to the reference guide 710. The reference guide 710 is disposed along the conveyance direction of the sheet S. When an end of the sheet S contacts the reference guide 710, the position of the sheet S in the width direction is aligned. The term "oblique" also means to have an inclination with respect to the reference guide 710.

In a section XL (indicated by a two-directional arrow illustrated in FIG. 4) (the distance in a reversing conveyance path from the nip portion of the fixing roller 704 serving as a conveyance unit of the image forming unit to the branch point A) where the sheet S is conveyed only by the reversing roller pairs rotating in a rotational direction L (indicated by an arrow illustrated in FIG. 4), the sheet S is conveyed while minutely rotating (swiveling) in the upper left direction (direction C (indicated by arrows C)) because of the outer diameter difference between the switchback rollers 105-*a* and 105-*a*', as illustrated in FIG. 2. While the sheet S is being held and conveyed by the reversing roller pairs and the nip portion of the fixing roller 704, the fixing roller 704 provides a larger conveyance force than the reversing roller pairs. Therefore, the sheet S is not obliquely conveyed and the reversing roller pairs slip against the sheet S.

Then, after the switchback rollers 105-*a* and 105-*a*' reverses the rotational direction from L to R, in a section XR (indicated by a two-directional arrow XR) (the distance from the nip portion of the switchback rollers 105-*a* and 105-*a*' to the nip portion of the oblique conveyance roller pair 705) from L to R, the rotational direction is reversed, as illustrated in FIG. 3. Therefore, the sheet S is conveyed while minutely rotating (swiveling) in the lower left direction (direction C') illustrated in FIG. 3. More specifically, the reversely rotating reversing roller pairs obliquely convey the sheet S while minutely rotating it in the sheet conveyance direction. Thus, the sheet S is conveyed so that a side end of the sheet S becomes closer to a reference guide 301 and the reference guide 710 in the width direction.

As illustrated in FIG. 4, starting at a branch point A on the reversing conveyance path between the fixing nip portion of the fixing roller 704 of an image forming unit and the reversing roller pairs, the double-sided conveyance path branches from the reversing conveyance path.

In the first exemplary embodiment, the distance XL over which the sheet S is conveyed only by the reversing roller pairs is set shorter than the distance XR. More specifically, since the distance XR after reversing the switchback roller 105-*a* is longer than the distance XL, the sheet S is conveyed while being shifted to the left side in FIG. 3. The reference guide 301 (guide member) for determining the position in the width direction of the sheet S, which is perpendicular to the sheet conveyance direction, is provided in the direction in which the sheet S is shifted. Thus, the sheet S obliquely conveyed while being minutely rotated by the switchback rollers 105-*a* and 105-*a*' becomes closer to the reference guide 301. Then, the position of the sheet S in the width direction is aligned with the reference guide 301 while a side end is moving along (coming in contact with) the contact portion of the reference guide 301.

When the leading edge of the sheet S conveyed by the switchback rollers 105-*a* and 105-*a*' reaches the oblique conveyance roller pair 705, the sheet S is further conveyed by the oblique conveyance roller pair 705 in a state of being shifted toward the reference guide 710 for determining the position of the sheet S in the width direction. Subsequently, in a state where the position of the sheet S is aligned with respect to a reference by the reference guide 710, the sheet S is conveyed to the registration roller pair 702 by a re-feed roller 706, and then an image is formed on the back surface of the sheet S by the transfer roller 703 and the fixing roller 704. Then, a flapper 707 rotates in the direction indicated by an arrow F illustrated in FIG. 4. The sheet S is discharged onto a discharge tray 709 outside the image forming apparatus by a discharge roller pair 708.

As described above, according to the first exemplary embodiment, the outer diameter of the switchback roller 105-*a*' disposed on the side away from the contacting portions of the reference guides 301 and 710 in the width direction is larger than the outer diameter of the switchback roller 105-*a*. Further, the amount of shift (the amount of oblique conveyance) of the sheet S can be increased by inclining one roller of the oblique conveyance roller pair 705 toward the reference guide 710. As a result, the sheet S can reliably contact the reference guides 301 and 710, guaranteeing the positional accuracy of the sheet S in the width direction.

Although, in the above-described first exemplary embodiment, the outer diameters are differentiated between the switchback rollers 105-*a* and 105-*a*' and one roller of the oblique conveyance roller pair 705 is inclined toward the reference guide 710, the present exemplary embodiment should not be limited thereto. For example, the present exemplary embodiment may be configured with three or more switchback rollers or configured with no oblique conveyance roller pair.

Although, in the above-described first exemplary embodiment, a roller pair for discharging the sheet S and a roller pair for reversing the sheet S are separately provided, the present exemplary embodiment should not be limited thereto. The present exemplary embodiment may be applied to a triplet roller configuration (in which two driven rollers face one drive roller).

Figure 5A:
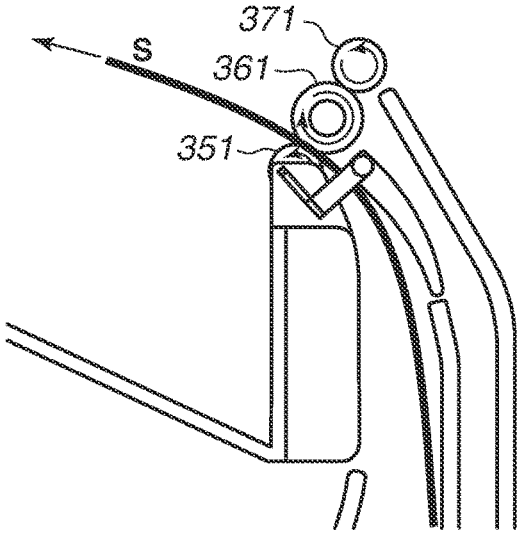
FIGS. 5A, 5B, and 5C illustrate a triplet roller configuration to which an exemplary embodiment of the present invention is applied.
Figure 5B:
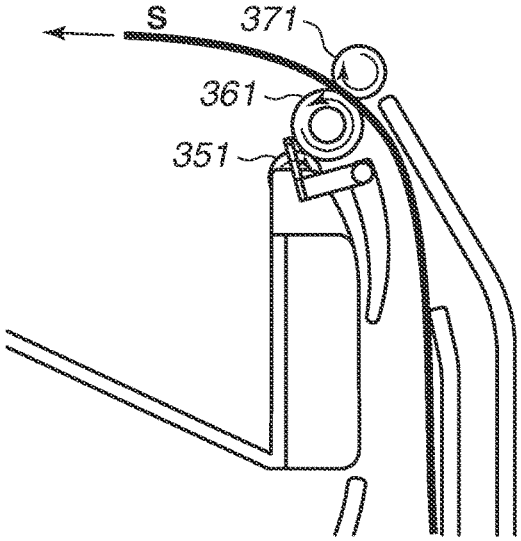
Figure 5C:
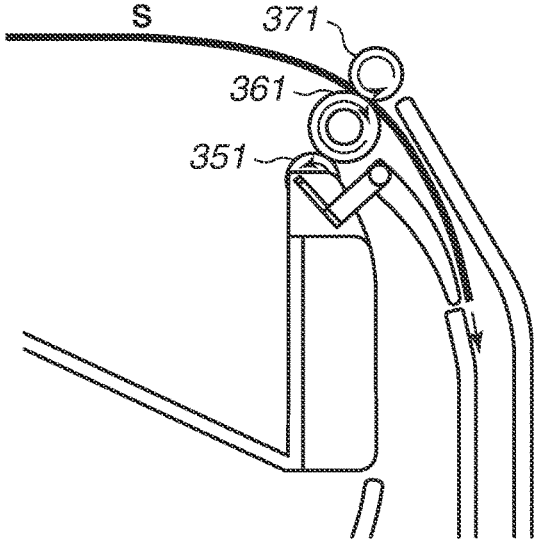
Figure 6:
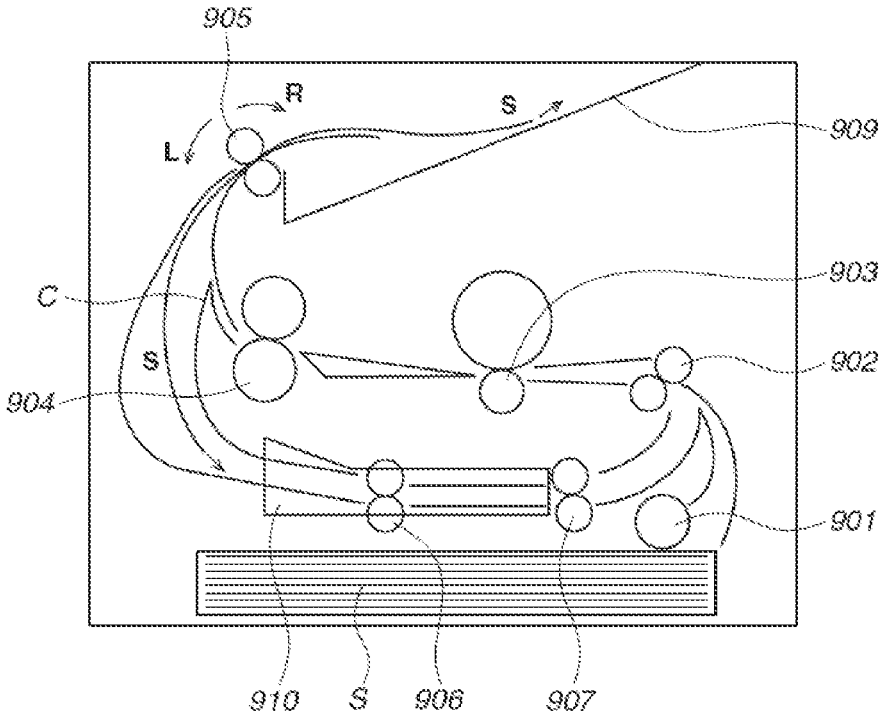
FIG.6 Prior Art
FIG. 6 is a sectional view illustrating a conventional image forming apparatus.

A triplet roller configuration according to the present exemplary embodiment will be described below with reference to FIGS. 5A to 5C. FIGS. 5A to 5C illustrate only the vicinity of a triplet roller including a first roller unit 361, a second roller unit 351, and a third roller unit 371. The configuration of other portions is similar to that according to the above-described first exemplary embodiment, and redundant descriptions thereof will be omitted.

The first roller unit 361 is disposed so that it is forwardly and reversely rotatable by receiving a driving force from a motor (driving source) for generating a driving force.

The rotation center of the second roller unit 351 is disposed vertically below the rotation center of the first roller unit 361, and the second roller unit 351 is in pressure contact with the first roller unit 361. The second roller unit 351 and the first roller unit 361 form a nip portion (first nip portion), and the second roller 351 rotates being driven by the rotation of the first roller 361. As illustrated in FIG. 5A, when discharging the sheet S onto a sheet stacking unit, the second roller unit 351 rotates being driven by the forward rotation of the first roller unit 361.

The rotation center of the third roller unit 371 is disposed vertically above the rotation center of the first roller unit 361, and the third roller unit 371 is brought into pressure contact with the first roller unit 361. The third roller unit 371 and the first roller unit 361 form a nip portion (second nip portion), and the third roller unit 371 rotates being driven by the rotation of the first roller unit 361. As illustrated in FIGS. 5B and 5C, when conveying the sheet S to the image forming unit again, the third roller 371 rotates being driven by the first roller 361 that reversely rotates and then forwardly rotates.

In the triplet roller configuration according to the present exemplary embodiment, the first roller unit 361 includes two switchback rollers (a first drive roller and a second drive roller) having different outer diameters, and the second roller unit 351 and the third roller unit 371 rotate being driven by the rotation of the respective two switchback rollers. Therefore, in the triplet roller configuration according to the present exemplary embodiment, when discharging the sheet S, the sheet S can be discharged by the first roller unit 361 and the second roller unit 351. In this case, both in the sheet conveyance by the first roller unit 361 and the second roller unit 351 and the sheet conveyance by the first roller unit 361 and the third roller unit 371, the respective two rollers obliquely convey the sheet S while minutely rotating the sheet S. However, in the sheet conveyance by the first roller 361 and the second roller 351 (the sheet conveyance at the first nip portion), while the trailing edge of the sheet S is nipped by the fixing roller 704, the conveyance force of the fixing roller 704 largely affects the sheet conveyance and therefore the sheet S is discharged to the outside of the image forming apparatus with a small degree of oblique conveyance. On the other hand, in the sheet conveyance by the first roller 361 and the third roller 371 (the sheet conveyance at the second nip portion), after the trailing edge of the sheet S passes through the fixing nip portion of the fixing roller 704, the conveyance distance illustrated in FIG. 5C is longer than that illustrated in FIG. 5B and therefore the sheet S can be obliquely conveyed in a state of being sufficiently shifted toward a desired direction. More specifically, the distance over which the sheet S is conveyed by the forward rotation of the first roller unit at the second nip portion after the trailing edge of the sheet S passes through the fixing nip portion is shorter than the distance over which the sheet S is conveyed by the reverse rotation of the first roller unit at the second nip portion. Accordingly, the sheet S is obliquely conveyed while being minutely rotated by the first roller unit 361 and the third roller unit 371. Then, the sheet S is further obliquely conveyed by the oblique conveyance roller pair 705 disposed obliquely toward the reference guide 710, and is then brought into contact with the reference guides 301 and 710.

The number of switchback rollers having different outer diameters provided by the first roller unit 361 should not be limited to two. Even when there are more than two switchback rollers, similar effects can be acquired as long as the outer diameter increases with increasing distance from the reference guides 301 and 710 in the width direction.

The present exemplary embodiment should not be limited to a configuration in which the second roller unit 351 and the third roller unit 371 rotate being driven by the first roller unit 361. The second roller unit 351 and the third roller unit 371 may be configured to rotate by receiving a driving force from the above-described motor or another driving source. This also applies to other configurations in the present specification.

Although, in the above-described first exemplary embodiment, there is no other roller pair in the conveyance path between the fixing roller 704 and the reversing roller pairs (i.e., the fixing roller 704 serves as a conveyance unit for conveying the sheet S to the reversing roller pairs), the present exemplary embodiment is not limited thereto.

The improvement in positional accuracy (printing accuracy) for image forming on a sheet and the reduction in occurrence rate of jam are demanded for image forming apparatuses such as copying machines, printers, and facsimile machines. A certain configuration is known to correct the position of the sheet S in the width direction by obliquely conveying the sheet with oblique conveyance rollers to bring a sheet edge in the width direction to contact a reference plate in a double-sided conveyance path where the sheet is conveyed before an image is formed on the back surface. Another configuration is known to correct the position of the sheet S in the width direction by obliquely conveying the sheet with oblique conveyance rollers to bring a side end (a sheet edge in the width direction) to contact with a reference plate in the sheet conveyance path between a feeding cassette and a transfer unit.

Figure 7:
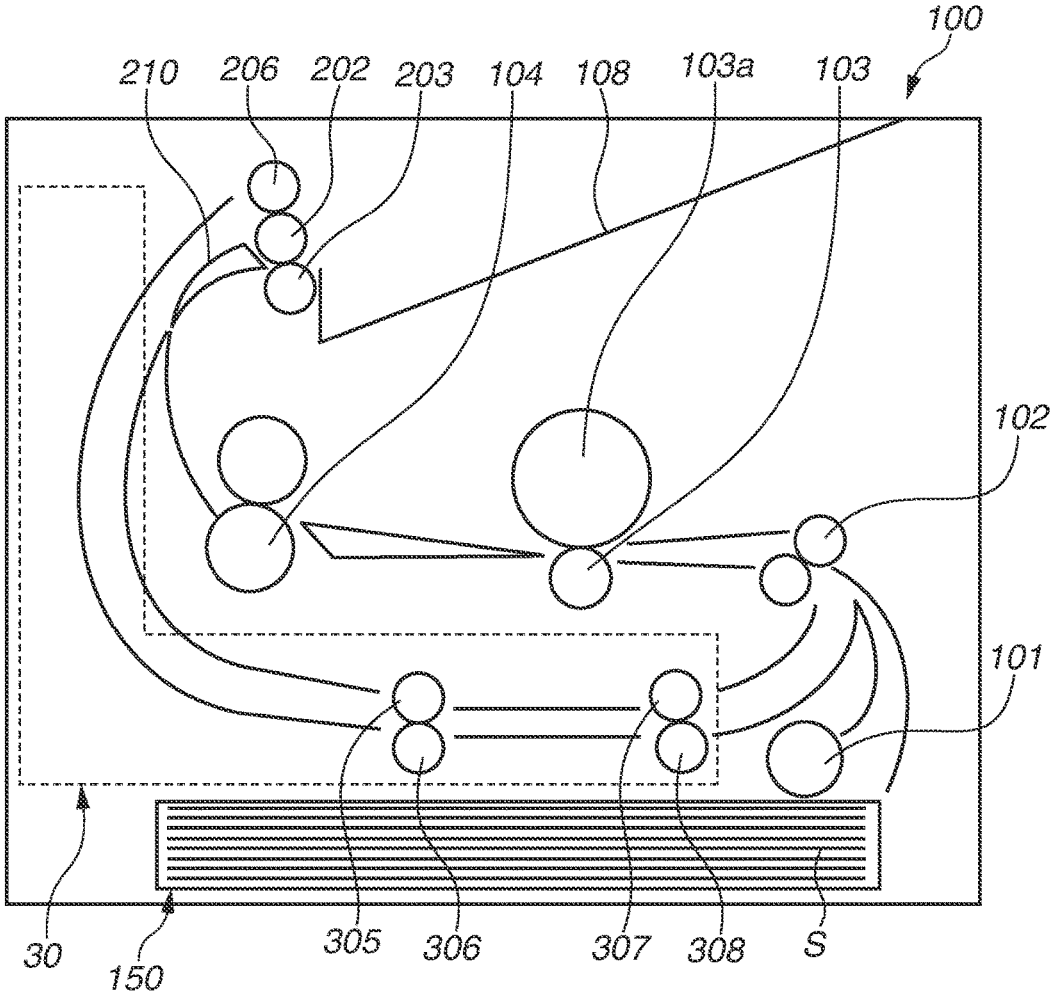
FIG. 7 is a schematic sectional view illustrating an image forming apparatus according to a second exemplary embodiment.

In the above-described configurations, however, there has been a case where, if the sheet is conveyed with the position of a side end of the sheet S shifted more outwardly than the reference plate, the leading edge of the sheet S in the sheet conveyance direction may be caught by the reference plate and jam may occur. There has been another case where, when the sheet is conveyed with the position of the sheet S in the width direction largely shifted from the reference plate, a side end of the sheet cannot be reliably brought into contact with the reference plate by an oblique conveyance unit. A second exemplary embodiment configured to solve the above-described problems will be described below. FIG. 7 is a schematic sectional view illustrating a laser beam printer (image forming apparatus) 100. Operations since the sheet S is fed until it is discharged will be described below with reference to FIG. 7. The sheet S stored in the feeding cassette (storage unit) 150 is fed by the feed roller (feeding member) 101 and then conveyed toward a registration roller pair 102. The registration roller pair 102 conveys the sheet S to the nip portion (transfer unit) between a transfer roller 103 and a photosensitive drum (image bearing member) 103*a* in synchronization with an image on the photosensitive drum 103*a*. Meanwhile, the printer 100 forms a latent image on the photosensitive drum 103*a* based on a print signal and image information, and develops the latent image with toner. When the toner image on the photosensitive drum 103*a* is transferred onto the sheet S, an image is formed on the sheet S. Subsequently, the sheet S is sent to the fixing device 104, in which the toner image on the sheet S is heated and pressurized to fix the toner image onto the sheet S. Then, when the sheet S is discharged, the sheet S is guided by a flapper (guide member) 210 and then discharged onto a discharge tray 108 by a discharge nip portion between a drive roller 202 and a discharge roller 203. The drive roller 202 and the discharge roller 203 configure a discharge roller pair (i.e., drive roller 202 and discharge roller 203) for discharging the sheet S onto the discharge tray 108.

When forming an image on both surfaces of the sheet S, the sheet S with the toner image fixed thereon by the fixing device 104 is guided to the reversing nip portion between the drive roller 202 and the reversing roller 206 by the flapper 210. The drive roller 202 and the reversing roller 206 configure a reversing roller pair (i.e., drive roller 202 and reversing roller 206) as a first conveyance unit for conveying the sheet S with an image formed on the first surface to a double-sided conveyance path 30 to form an image on the second surface of the sheet S. After the sheet S reversed by the reversing roller pair (i.e., drive roller 202 and reversing roller 206) passes through the double-sided conveyance path 30, it passes through the transfer unit and the fixing device 104 again, and then is discharged onto the discharge tray 108 by the discharge roller pair (i.e., drive roller 202 and discharge roller 203).

Figure 18:
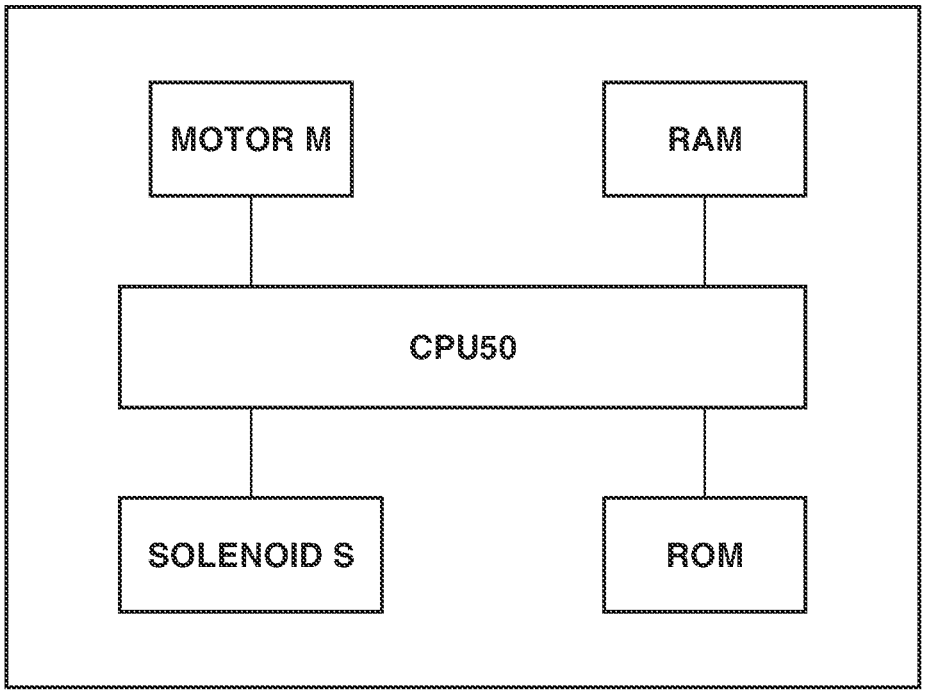
FIG. 18 is a block diagram according to the second exemplary embodiment.

FIG. 18 is a block diagram relating to the second exemplary embodiment. As illustrated in FIG. 18, a central processing unit (CPU) 50 is connected with a read only memory (ROM) and a random access memory (RAM). The CPU 50 executes a program stored in the ROM by using the RAM as a work memory. In the second exemplary embodiment, the CPU 50, the ROM, and the RAM configure a control unit. The CPU 50 connected with a motor (driving unit) M and a solenoid S controls the solenoid S to change the drive train between the motor M and the drive roller 202. This switches the direction in which the motor M rotates the drive roller 202. Since the solenoid S is also connected to the flapper 210 (described below), in the second exemplary embodiment, the CPU 50 controls the solenoid S to enable switching of the rotational direction of the drive roller 202 and the position of the flapper 210.

In the second exemplary embodiment, the drive roller 202 rotates being driven by a driving unit (the motor M illustrated in FIG. 18), and has a function of discharging the sheet S and a function of reversing the sheet S. The discharge roller 203 and the reversing roller 206 are driven rollers, which rotate being driven by the drive roller 202 and the sheet S, respectively.

Figure 8:
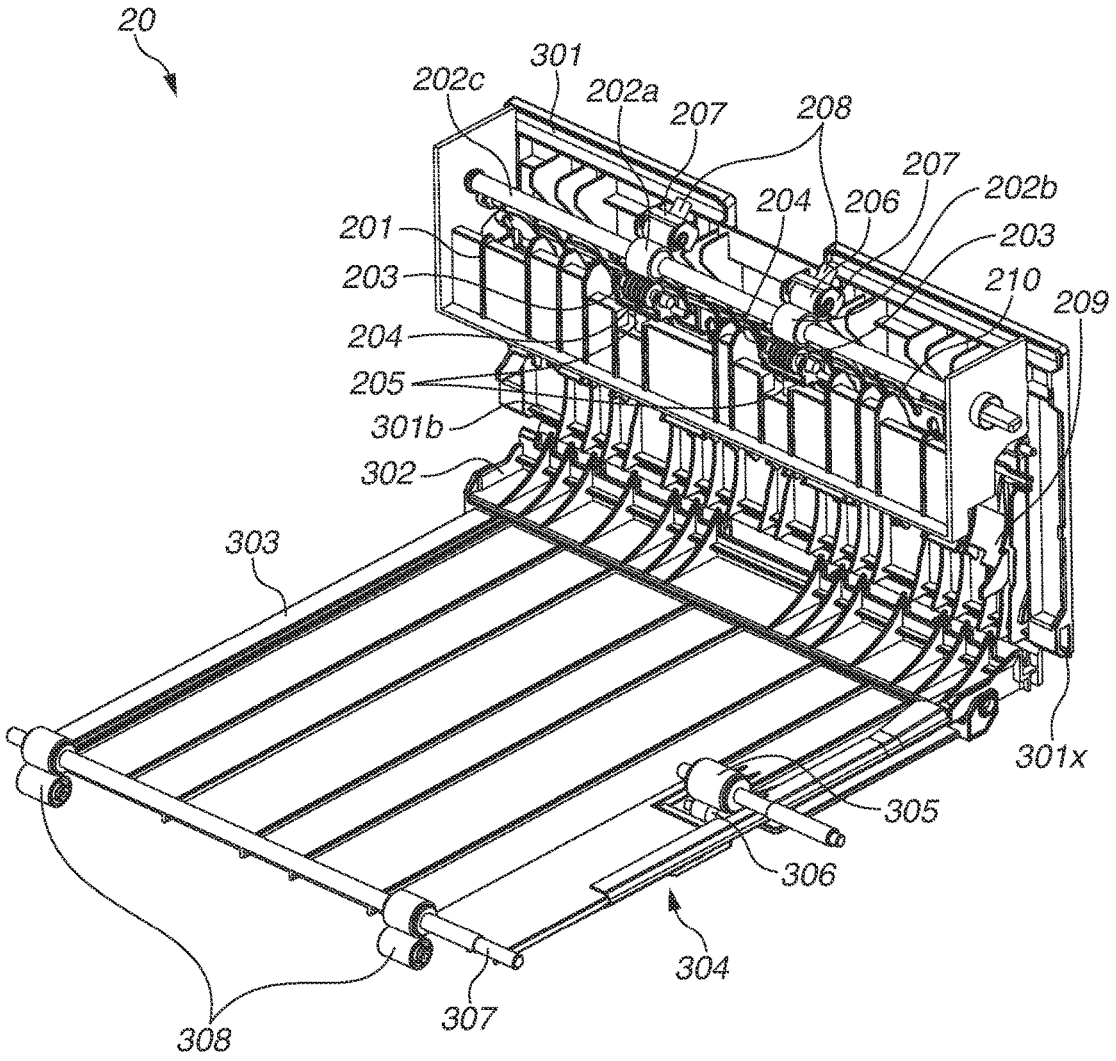
FIG. 8 is a perspective view illustrating the inside of a sheet conveyance apparatus according to the second exemplary embodiment.
Figure 10:
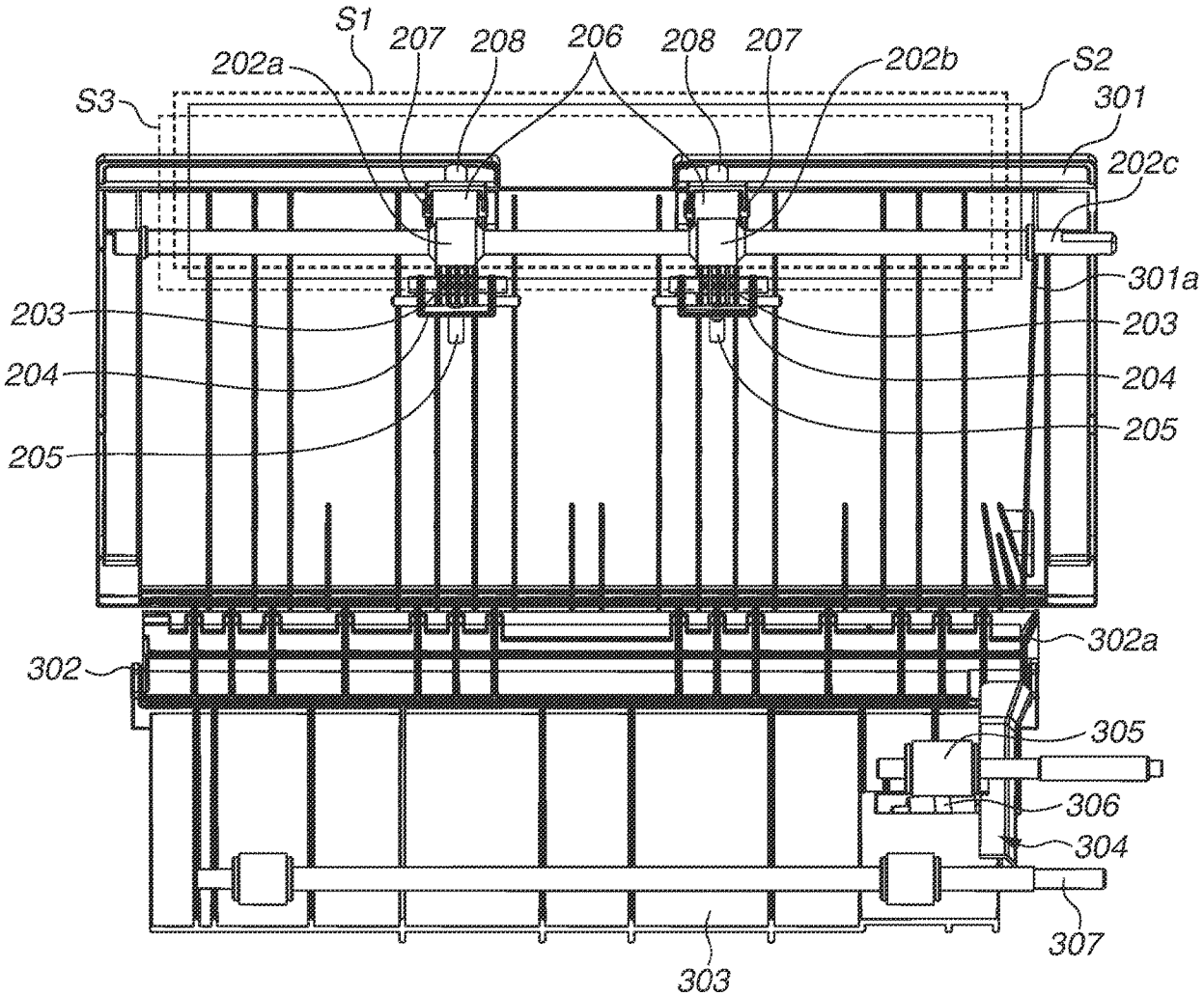
FIG. 10 is a perspective view illustrating the inside of the sheet conveyance apparatus according to the second exemplary embodiment, viewed from the apparatus body front side.

A sheet conveyance apparatus 20 of the printer 100 will be described below. FIG. 8 is a perspective view illustrating an internal configuration of the sheet conveyance apparatus 20. FIG. 10 is a perspective view illustrating the sheet conveyance apparatus 20, viewed from the apparatus body front side. The right side illustrated in FIG. 7 is the apparatus body front side, and the left side is the apparatus body rear side.

As illustrated in FIG. 8, the sheet conveyance apparatus 20 includes a discharge frame 201, drive roller 202, discharge rollers 203, discharge roller holders 204 for holding the discharge rollers 203, and discharge pressurizing springs 205 for elastically pressing the discharge rollers 203 toward the drive roller 202. The sheet conveyance apparatus 20 further includes reversing rollers 206, reversing roller holders 207 for holding the reversing rollers 206, and reversing pressurizing springs 208 for elastically pressing the reversing rollers 206 toward the drive roller 202. The sheet conveyance apparatus 20 further includes a discharge conveyance guide 209 as a conveyance path between the fixing device 104 and the drive roller 202, and the flapper 210 for changing the conveyance path of the sheet S.

The sheet conveyance apparatus 20 further includes the double-sided conveyance path 30 between the reversing roller pair (i.e., drive roller 202 and reversing roller 206) and the registration roller pair 102. The double-sided conveyance path 30 is composed mainly of a rear door (opening/closing member) 301, a rear cover 302, and a double-sided conveyance guide 303. As illustrated in FIGS. 8 and 10, the double-sided conveyance path 30 is provided with an abutting rib (first restricting member) 301*a*, a third restricting member 302*a*, a second restricting member 304, a second conveyance unit (i.e., second oblique conveyance roller 305 and second facing roller 306), and a re-feed roller pair (rollers 307 and 308). As illustrated in FIG. 10, the abutting rib 301*a*, the second restricting member 304, and the third restricting member 302*a* are provided on different members (the rear door 301, the rear cover 302, and the double-sided conveyance guide 303, respectively), i.e., separately positioned from each other in the sheet conveyance direction.

The rear door 301 forms a conveyance path extending from the top downward in the double-sided conveyance path 30. The double-sided conveyance guide 303 forms a conveyance path extending in the approximately horizontal direction in the double-sided conveyance path 30. The rear cover 302 forms a curved conveyance path (curved path) between the rear door 301 and the double-sided conveyance guide 303. The rear door 301 is openable/closable with respect to the apparatus body with a fulcrum 301*x* (see FIG. 8) as a rotation center. The user is able to perform treatment for jam of the sheet S inside the rear door 301 by opening the rear door 301. In other words, the rear door 301 is openable/closable with respect to the apparatus body, which is a member for supporting the double-sided conveyance guide 303.

As illustrated in FIGS. 8 and 10, the drive roller 202 have a rotating shaft 202*c*, and a first roller 202*a* (left side) and a second roller 202*b* (right side) fixed on the rotating shaft 202*c*. The first roller 202*a* has a larger outer diameter than the second roller 202*b*. Therefore, the sheet S conveyed from the top downward in the double-sided conveyance path 30 with the drive roller 202 is obliquely conveyed toward the right side illustrated in FIG. 4. It is desirable that the outer diameter of the first roller 202*a* is 1.005 to 1.025 times the outer diameter of the second roller 202*b*.

Figure 9A:
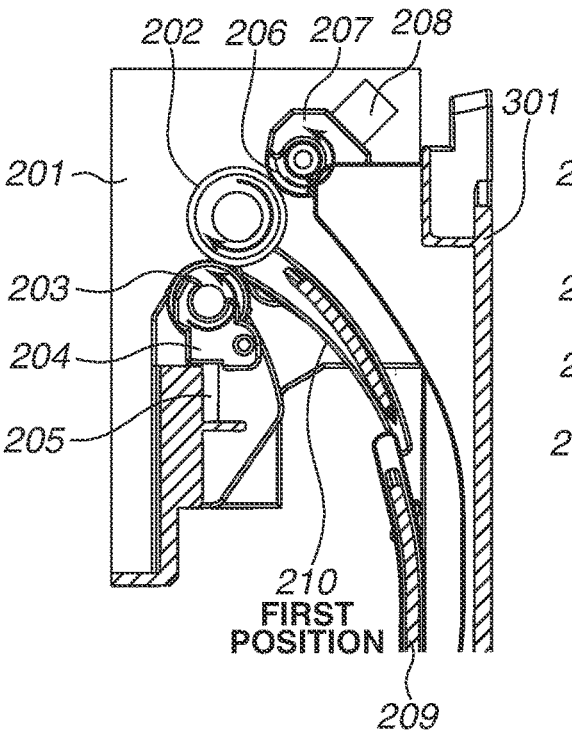
FIGS. 9A, 9B, and 9C are sectional views illustrating the sheet conveyance apparatus according to the second exemplary embodiment.
Figure 9B:
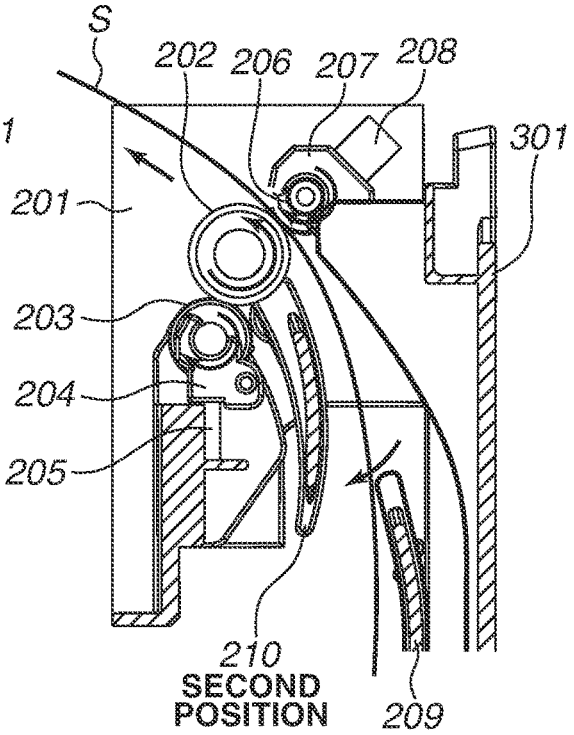
Figure 9C:
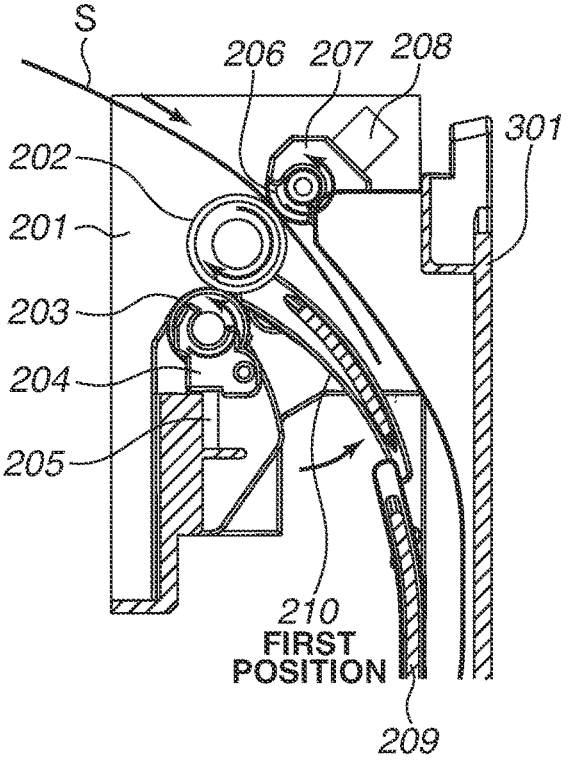

Operations of the flapper 210 and the drive roller 202 will be described below. FIGS. 9A to 9C are sectional views (parallel to the sheet conveyance direction) illustrating the sheet conveyance apparatus 20 in the vicinity of the flapper 210. The flapper 210 is movable between a first position (see FIG. 9A) for guiding the sheet S to the discharge nip portion and a second position (see FIG. 9B) for guiding the sheet S to the reversing nip portion. The sheet conveyance apparatus 20 has a stopper (not illustrated) for stopping the flapper 210 at the first and the second positions.

When discharging the sheet S, as illustrated in FIG. 9A, the drive roller 202 is rotating in the clockwise direction (first rotational direction) as the initial state. At this timing, the flapper 210 is located at the first position. Thus, the sheet S is discharged onto the discharge tray 108 by the discharge roller pair (i.e., drive roller 202 and discharge roller 203).

A case where an image is formed on both surfaces of the sheet S will be described below. When the sheet S that has passed through the fixing device 104 is conveyed from the discharge conveyance guide 209, as illustrated in FIG. 9B, the CPU 50 controls the solenoid S to switch the rotational direction of the drive roller 202 to the counterclockwise direction (second rotational direction). In synchronization with this operation, the flapper 210 rotates in the clockwise direction to move from the first position to the second position illustrated in FIG. 9B. Thus, the sheet S will be conveyed toward the reversing nip portion. Subsequently, as illustrated in FIG. 9C, at the timing when the trailing edge of the sheet S has passed through the discharge conveyance guide 209, the CPU 50 controls the solenoid S to switch the rotational direction of the drive roller 202 to the clockwise direction (first rotational direction). In synchronization with this operation, the flapper 210 rotates in the counterclockwise direction to move from the second position to the first position. Thus, the sheet S will be conveyed toward the double-sided conveyance path 30.

Figure 11:
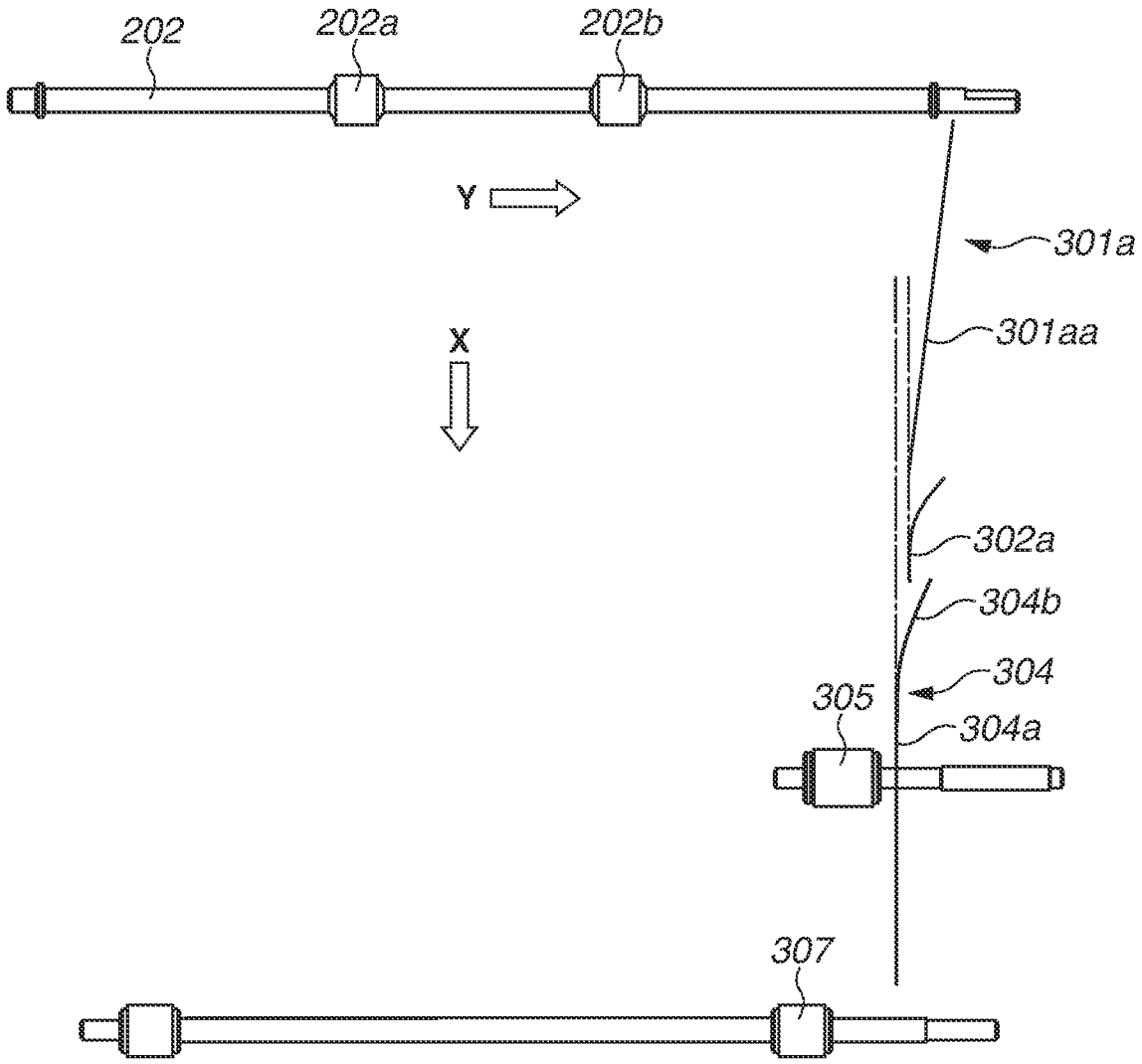
FIG. 11 is a schematic view illustrating the sheet conveyance apparatus according to the second exemplary embodiment.

FIG. 11 is a schematic diagram illustrating positions of components of the sheet conveyance apparatus 20 in the conveyance direction of the sheet S and in the width direction of the sheet S. The conveyance direction refers to the direction indicated by the arrow X, and the width direction refers to the direction perpendicular to the conveyance direction, indicated by the arrow Y, each illustrated in FIG. 11. In other words, the width direction of the sheet S refers to the direction perpendicular to the direction in which the transfer unit and the fixing device (image forming unit) convey the sheet S. The width direction is identical to the axial direction of the photosensitive drum 103*a*.

As described above, the sheet S conveyed by the reversing roller pair (i.e., drive roller 202 and reversing roller 206) is obliquely conveyed toward the right side in FIG. 4. The rear door 301 is provided with an abutting rib (first restricting member) 301*a* for restricting the position of the sheet S in the width direction. The abutting rib 301*a* is inclined to be closer to the inside in the width direction (the left side in FIG. 11) from the upstream to the downstream sides in the sheet conveyance direction. The abutting rib 301*a* has a first abutting portion 301*aa* (first contact portion). A side end of the sheet S (one side edge of the sheet S in the width direction) obliquely conveyed by the reversing roller pair (i.e., drive roller 202 and reversing roller 206) can abut on (come in contact with) the first abutting portion 301*aa*. In other words, the first abutting portion 301*aa* is shaped to be closer to the inside from the upstream to the downstream sides in the sheet conveyance direction, i.e., to be closer to the center of the double-sided conveyance path in the width direction.

On the downstream side of the abutting rib 301*a*, there are provided a second oblique conveyance roller 305 and a second facing roller 306 obliquely disposed with respect to a second oblique conveyance roller 305, i.e., the second conveyance unit (i.e., second oblique conveyance roller 305 and second facing roller 306) for obliquely conveying the sheet S. In the second exemplary embodiment, the second oblique conveyance roller 305 provided on a rotating shaft parallel to the width direction of the sheet S rotates driven by the motor M or another driving source. The second facing roller 306, a driven roller which rotates being driven by the second oblique conveyance roller 305 and the sheet S, is obliquely disposed with respect to the rotating shaft of the second oblique conveyance roller 305 (in the width direction of the sheet S). The second conveyance unit (i.e., second oblique conveyance roller 305 and second facing roller 306) nips and conveys the sheet S.

The double-sided conveyance guide 303 is provided with the second restricting member 304 for restricting the position of the sheet S in the width direction. As illustrated in FIG. 11, the second restricting member 304 has a second abutting portion 304*a*. A side end of the sheet S obliquely conveyed by the second conveyance unit (i.e., second oblique conveyance roller 305 and second facing roller 306) is abutted on the second abutting portion 304*a*. The second abutting portion 304*a* is a plane parallel to the conveyance direction of the sheet S, and is disposed at a position (reference position) to be used as a reference in the width direction when the transfer unit transfers an image onto the sheet S. An upstream side portion 304*b* of the second restricting member 304 is inclined to be closer to the inside (the left side in FIG. 11) in the width direction from the upstream to the downstream sides in the sheet conveyance direction.

When the second conveyance unit (i.e., second oblique conveyance roller 305 and second facing roller 306) conveys the sheet S while abutting a side end of the sheet S on the second abutting portion (second contacting portion) 304*a*, the position of the sheet S is corrected. Then, the sheet S is conveyed to the registration roller pair 102 by the re-feed rollers 307 and 308, and then enters the same conveyance path as that for the first surface. Subsequently, after the sheet S passes through the transfer unit and the fixing device 104, it is discharged onto a discharge tray 109 by the discharge roller pair (i.e., drive roller 202 and discharge roller 203).

The sheet conveyance apparatus 20 has a third restricting member 302*a* disposed on the rear cover 302. The third restricting member 302*a* is able to restrict the position of a side end of the sheet S being conveyed from the rear door 301 to the double-sided conveyance guide 303. As illustrated in FIG. 11, the third restricting member 302*a* is disposed between the abutting rib 301*a* and the second restricting member 304 in the conveyance direction of the sheet S. The position of the third restricting member 302*a* in the width direction is disposed more outwardly than the position of the reference position 304*a* in the width direction.

As illustrated in FIG. 11, the position of the downstream side end of the first abutting portion 301*aa* in the width direction is disposed more outwardly than the position of the second abutting portion 304*a* in the width direction. Therefore, when a side end of the sheet S is brought into contact with the second abutting portion 304*a*, the sheet S becomes parallel to the sheet conveyance direction, and this conveyance operation is not disturbed by the first abutting portion 301*aa*.

Conveyance operations of the sheet S will be described below with reference to FIG. 10. Referring to FIG. 10, a position S1 refers to a normal position of the sheet S when the sheet S has been conveyed without positional shift in the width direction. The sheet S may be conveyed in a state of being shifted from the normal position in the width direction depending on the setting condition in the feeding cassette 150 and conveyance state variation. A position S2 refers to a position of the sheet S when the sheet S has been conveyed in a state of being shifted to the right from the normal position S1 by a second predetermined amount or greater. A position S3 refers to a position of the sheet S when the sheet S has been conveyed in a state of being shifted to the left from the normal position S1 by a first predetermined amount or greater.

The sheet S which has been conveyed at the position S2 (hereinbelow, referred to as a sheet S2) will be described below. The sheet S2 is obliquely conveyed so as to be closer to the first abutting portion 301*aa* by the reversing roller pair (i.e., drive roller 202 and reversing roller 206). Then, the sheet S2 is conveyed with a side end thereof abutted on the first abutting portion 301*a*. The first abutting portion 301*a* is disposed more rightward (outward) from the sheet S2 conveyed in a state of being shifted to the right in the width direction. Therefore, in the second exemplary embodiment, the sheet S2 can be conveyed without the occurrence of jam occurring caused by the leading edge of the sheet S2 being caught by the upstream side end of the first abutting portion 301*aa*.

The first abutting portion 301*a* is shaped to be closer to the inside in the width direction from the upstream to the downstream sides in the sheet conveyance direction. This restricts a side end of the sheet S2 from being shifted more outwardly than the upstream side portion 304*b* of the second restricting member 304 in the width direction. In other words, the position of the downstream side end of the first abutting portion 301*aa* in the width direction is disposed more outwardly than the position of the upstream side end of the upstream side portion 304*b* of the second restricting member 304 in the width direction. Therefore, according to the second exemplary embodiment, it is possible to prevent jam occurring caused by the leading edge of the sheet S2 being caught by the upstream side portion 304*b* of the second restricting member 304.

The sheet S2 conveyed with the position of a side end thereof restricted by the first abutting portion 301*aa* passes through the third restricting unit 302*a* on the conveyance path of the rear cover 302, and is conveyed by the second conveyance unit (i.e., second oblique conveyance roller 305 and second facing roller 306). The sheet S2 is conveyed by the second conveyance unit (i.e., second oblique conveyance roller 305 and second facing roller 306) while being abutted on the second abutting portion 304*a*. Subsequently, the sheet S2 is conveyed to the nip portion of a re-feed roller pair (i.e., re-feed rollers 307 and 308).

When conveying the sheet S2, it is important that the first abutting portion 301*aa* is shaped to be closer to the inside in the width direction from the upstream to the downstream sides thereof in the sheet conveyance direction. In a configuration without the first abutting portion 301*aa*, when the sheet S2 is conveyed with a side end of the sheet S2 shifted more rightward than the upstream side portion 304*b* of the second restricting member 304, the leading edge of the sheet S may be caught by the upstream side portion 304*b*. According to the second exemplary embodiment, the position of the sheet S2 conveyed in a state of being shifted to the side (right side) closer to the reference position (the position of the second abutting portion 304*a*) can be returned to the side (left side) more away from the reference position by the first abutting portion 301*aa*. Therefore, according to the second exemplary embodiment, the sheet S can be stably conveyed even if the sheet S is conveyed in a state of being largely shifted toward the side close to the reference position (the position of the second abutting portion 304*a*).

The sheet S that has been conveyed to the position S1 (hereinbelow, referred to as a sheet S1) is abutted on the first abutting portion 301*aa* by the reversing roller pair (i.e., drive roller 202 and reversing roller 206), and then conveyed in a state of being abutted on the second abutting portion 304*a* by the second conveyance unit (i.e., second oblique conveyance roller 305 and second facing roller 306). More specifically, taking into consideration only a case where the sheets S1 and S2 are conveyed, the reversing roller pair c does not necessarily need to have the function of obliquely conveying the sheet S1 or S2.

The sheet S that has been conveyed at the position S3 (hereinbelow referred to as a sheet S3) will be described below. The sheet S3 is obliquely conveyed so as to be closer to the first abutting portion 301*aa* by the reversing roller pair (i.e., drive roller 202 and reversing roller 206). At this timing, since the sheet S3 is largely separated from the first abutting portion 301*aa*, a side end of the sheet S3 may not be abutted on the first abutting portion 301*aa* by the reversing roller pair (i.e., drive roller 202 and reversing roller 206).

Subsequently, the conveyed sheet S3 passes through the third restricting unit 302*a* on the conveyance path of the rear cover 302, and then is conveyed by the second conveyance unit (i.e., second oblique conveyance roller 305 and second facing roller 306). The sheet S3 is conveyed in a state of being abutted on the second abutting portion 304*a* by the second conveyance unit (i.e., second oblique conveyance roller 305 and second facing roller 306). Subsequently, the sheet S3 is conveyed to the nip portion between the re-feed rollers 307 and 308.

When conveying the sheet S3, it is important that the reversing roller pair (i.e., drive roller 202 and reversing roller 206) obliquely conveys the sheet S. With the reversing roller pair (i.e., drive roller 202 and reversing roller 206) configured to convey the sheet S straight (configured not to obliquely convey the sheet S) with respect to the sheet conveyance direction, a side end of the sheet S3 may not be abutted on the second abutting portion 304*a* by the second conveyance unit (i.e., second oblique conveyance roller 305 and second facing roller 306). If the position of a side end of the sheet S3 is largely separated from the second abutting portion 304*a* at the time when the sheet S3 reaches the second conveyance unit (i.e., second oblique conveyance roller 305 and second facing roller 306), the amount of oblique conveyance of the sheet S3 may not be sufficient only by the second conveyance unit (i.e., second oblique conveyance roller 305 and second facing roller 306). In other words, according to the second exemplary embodiment, if the reversing roller pair (i.e., drive roller 202 and reversing roller 206) obliquely conveys the sheet S3, the position of a side end of the sheet S3 at the time when the sheet S3 reaches the second conveyance unit (i.e., second oblique conveyance roller 305 and second facing roller 306) can be brought close to the second abutting portion 304*a*. Therefore, according to the second exemplary embodiment, the position of the sheet S can be corrected even if the sheet S is conveyed n a state of being largely shifted to the left from the reference position in the width direction.

The above-described conveyance operations for the sheets S1 to S3 is for the sheet S of the letter size. Actually, the sheet conveyance apparatus 20 can convey the sheets S of a plurality of sizes. To accurately convey the sheets S of a plurality of sizes, it is important to appropriately arrange the first abutting rib 301*a* and appropriately design the amount of oblique conveyance by the reversing roller pair (i.e., drive roller 202 and reversing roller 206).

With the reversing roller pair (i.e., drive roller 202 and reversing roller 206) configured to obliquely convey the sheet S, the sheet S may be largely swiveled rightward at the moment when the trailing edge of the sheet S exits the nip portion of the reversing roller pair (i.e., drive roller 202 and reversing roller 206). Therefore, it is important that the first abutting portion 301*aa* restricts the position of a side end of the sheet S. However, taking into consideration only a case where the sheets S1 and S3 are conveyed, the first abutting portion 301*aa* is not necessarily shaped to be closer to the inside in the width direction from the upstream to the downstream sides thereof in the sheet conveyance direction, and may be parallel to the sheet conveyance direction.

As described above, according to the second exemplary embodiment, the sheet S can be obliquely conveyed also on the conveyance path extending downward from the top inside the rear door 301. Therefore, according to the second exemplary embodiment, also in an apparatus having the short double-sided conveyance path 30, the sheet S is reliably abutted on the second abutting portion 304*a* to enable correcting the position of the sheet S.

Figure 12:
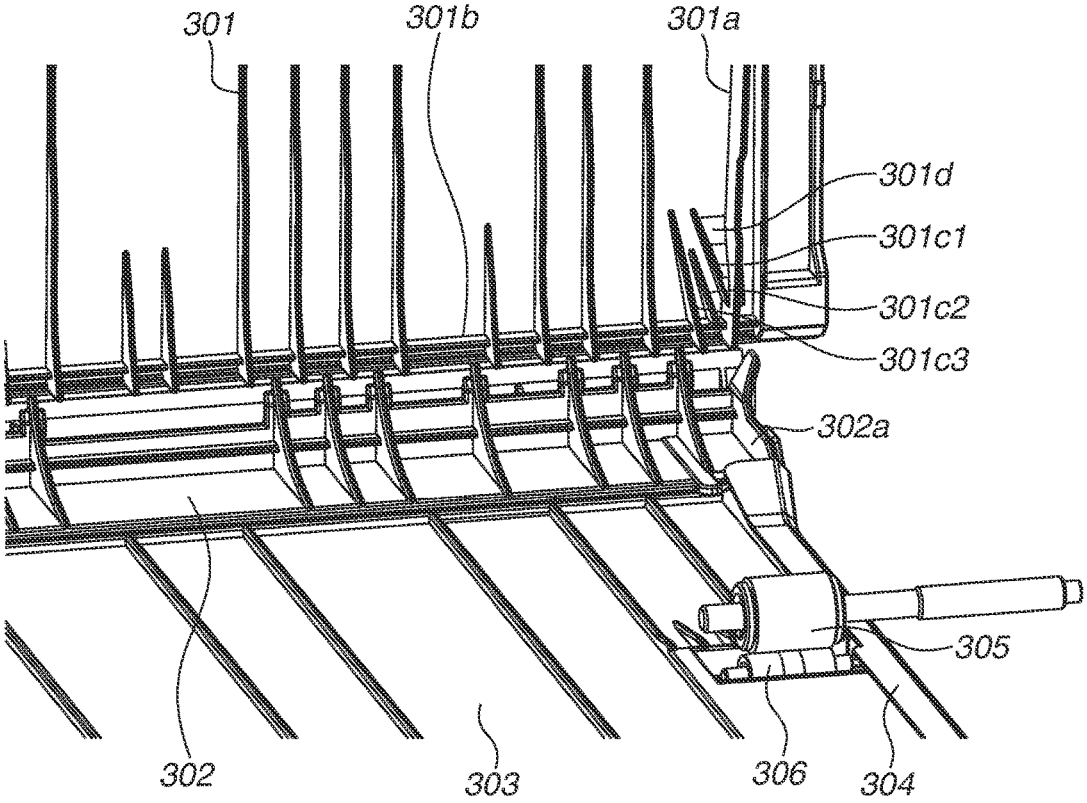
FIG. 12 is a perspective view illustrating the inside of the sheet conveyance apparatus according to the second exemplary embodiment.

As illustrated in FIG. 12, the rear door 301 is provided with a perpendicular rib (parallel rib) 301*b* extending in the direction perpendicular to the sheet conveyance direction (i.e., in the direction parallel to the width direction). FIG. 12 is a perspective view illustrating the inside of the sheet conveyance apparatus 20, in the vicinity of the perpendicular rib 301*b*. The perpendicular rib 301*b* is a rib for reinforcing the strength of the rear door 301. The perpendicular rib 301*b* may not be strictly parallel to the width direction and may be approximately parallel thereto. The rear door 301 is provided with three inclined ribs 301*c*1, 301*c*2, and 301*c*3, and a conveyance surface 301*d* in the vicinity of the area where the abutting rib 301*a* intersects with the perpendicular rib 301*b*. The three inclined ribs 301*c*1, 301*c*2, and 301*c*3 are shaped to extend outwardly in the width direction from the upstream to the downstream sides in the sheet conveyance direction, to prevent jam occurring when the vicinity of a side end of the sheet S is caught by the perpendicular rib 301*b*.

The downstream side of the inclined rib (first inclined rib) 301*c*1 in the sheet conveyance direction is connected to the abutting rib 301*a*, and the conveyance surface 301*d* is formed between the inclined rib 301*c*1 and the abutting rib 301*a*. If the sheet S is conveyed along the abutting rib 301*a* or if the sheet S is conveyed toward the abutting rib 301*a*, this configuration enables guiding the sheet S while raising the vicinity of a side end thereof with the inclined rib 301*c*1. Therefore, the sheet S can be prevented from being caught by the perpendicular rib 301*b*. Further, since the conveyance surface 301*d* is formed between the inclined rib 301*c*1 and the abutting rib 301*a*, the sheet S can be raised in a more reliable way.

Even when the sheet S is conveyed in a state of being shifted to the left in the width direction similar to the above-described sheet S3, the inclined ribs (the second inclined rib 301*c*2 and the third inclined rib 301*c*3) are able to raise a side end of the sheet S, thus preventing the sheet S from being caught by the perpendicular rib 301*b*. In other words, when the sheet S is conveyed in a state of being shifted to the side away from the normal position by the first predetermined amount or more in the width direction, the inclined ribs (the second inclined rib 301*c*2 and the third inclined rib 301*c*3) guide a side end of the sheet S.

Figure 13:
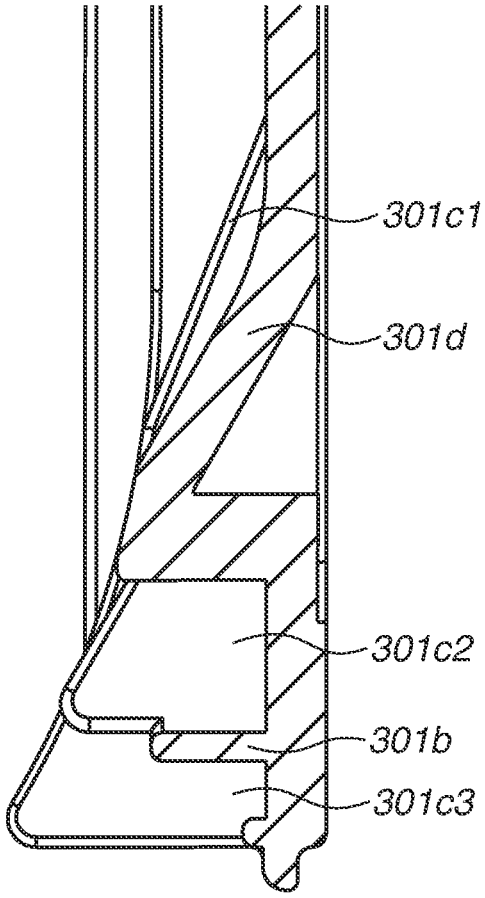
FIG. 13 is a sectional view illustrating the sheet conveyance apparatus according to the second exemplary embodiment.

FIG. 13 is a sectional view (a sectional view parallel to the sheet conveyance direction) illustrating the vicinity of the perpendicular rib 301*b*. The height (the length of the sheet S in the thickness direction) of the conveyance surface 301*d* is lower than that of the inclined rib 301*c*1 and becomes equal as coming close to the downstream side. The inclined rib 301*c*2 is formed so that the height is low in the vicinity of the upstream side of the perpendicular rib 301*b*. The inclined rib 301*c*3 exceeds the perpendicular rib 301*b* and extends to the downstream side in the sheet conveyance direction.

Figure 14:
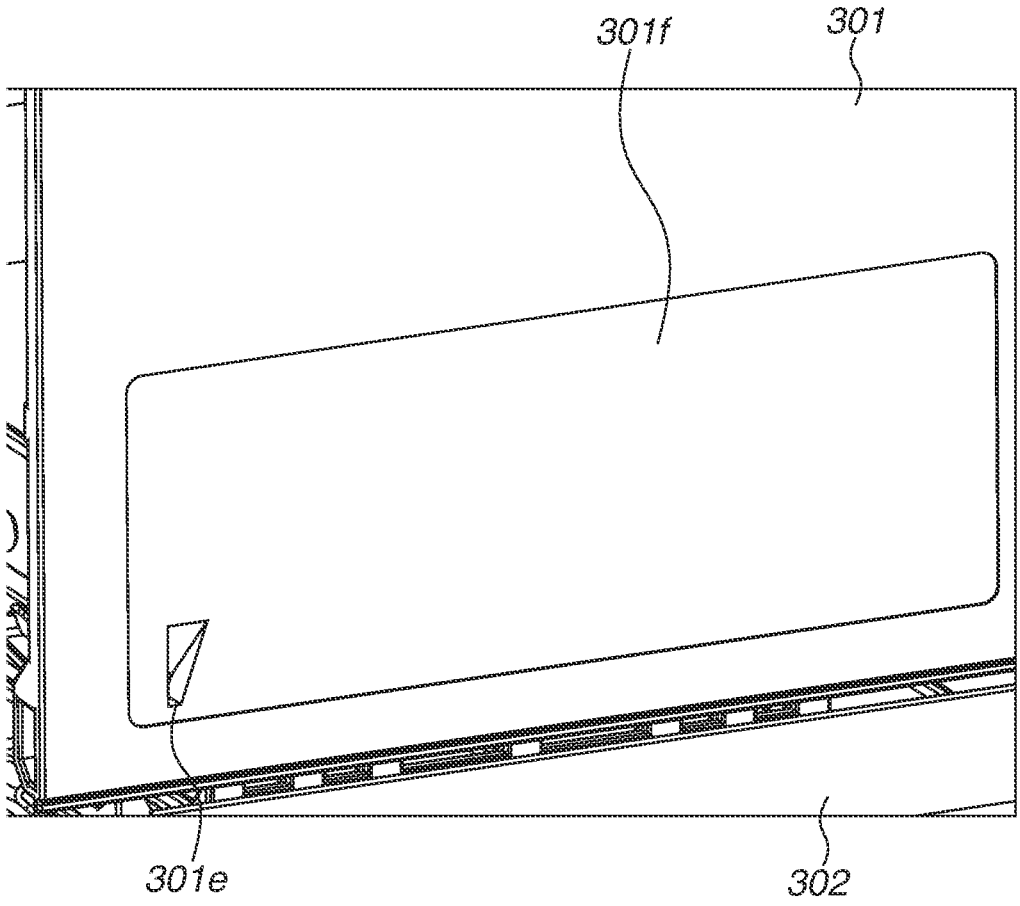
FIG. 14 is a perspective view illustrating the sheet conveyance apparatus according to the second exemplary embodiment, viewed from the apparatus body rear side.

FIG. 14 is a perspective view illustrating the sheet conveyance apparatus 20, viewed from the apparatus back side. In the second exemplary embodiment, as illustrated in FIG. 14, a hollow shape (lightening portion) 301*e* is provided on the back surface of the rear door 301 to prevent the occurrence of sink occurring due to the formation of the rear door 301 and the conveyance surface 301*d* with resin. Since the back surface of the rear door 301 is the exterior surface seen from the outside, the hollow shape 301*e* is covered by a label (seal) in the second exemplary embodiment. A label pasting area 301*f* is an area on the exterior surface of the rear door 301 where a label is stuck.

Figure 15:
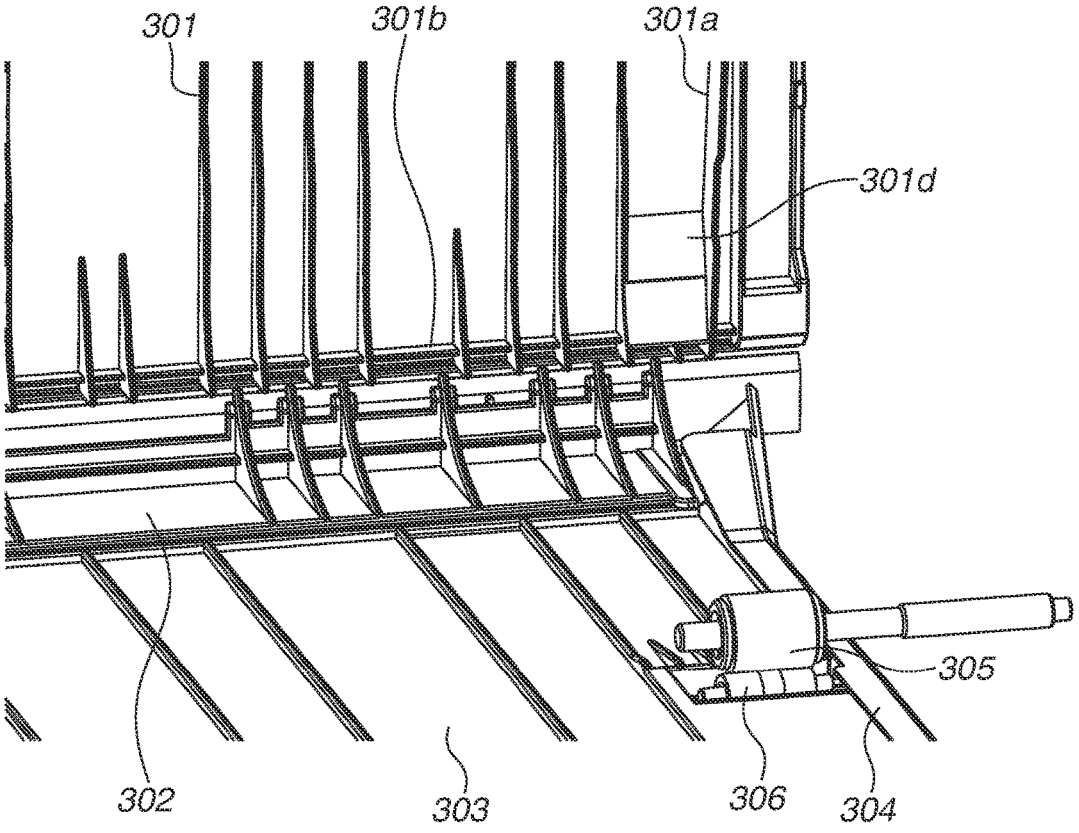
FIG. 15 is a perspective view illustrating the inside of a sheet conveyance apparatus according to a third exemplary embodiment.
Figure 16:
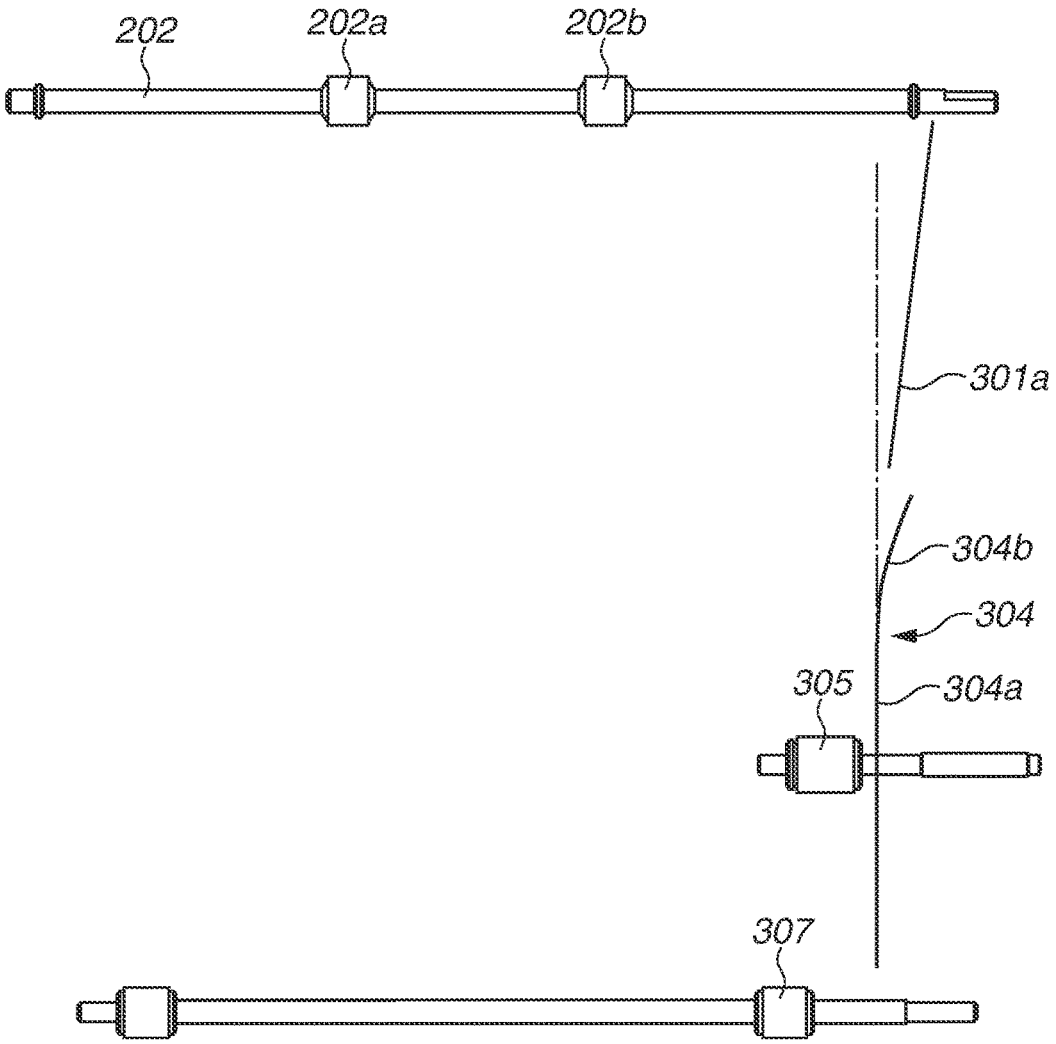
FIG. 16 is a schematic view illustrating the sheet conveyance apparatus according to the third exemplary embodiment.
Figure 17:
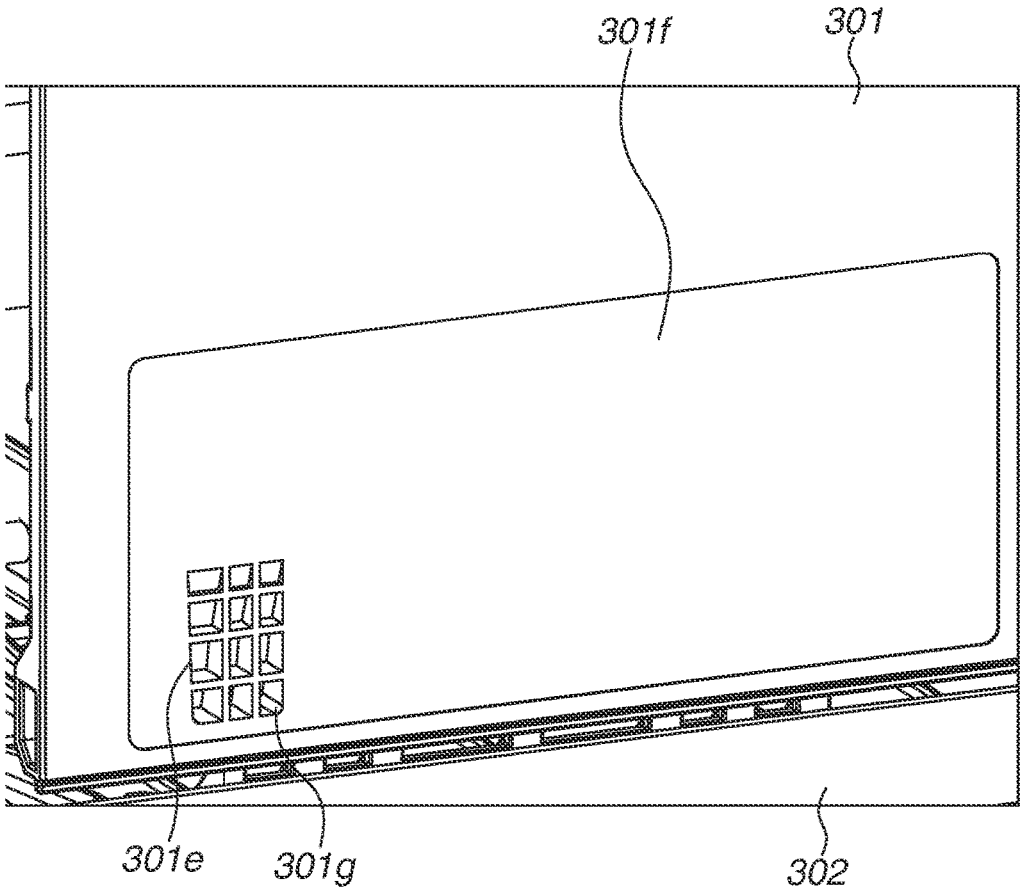
FIG. 17 is a perspective view illustrating the sheet conveyance apparatus according to the third exemplary embodiment, viewed from the apparatus body back side.

A third exemplary embodiment according to the present invention will be described below with reference to FIGS. 15 to 17. In the following descriptions of the third exemplary embodiment, descriptions of configurations and operations common to the second exemplary embodiment will be suitably omitted. FIG. 15 is a perspective view illustrating a sheet conveyance apparatus according to the third exemplary embodiment. FIG. 16 is a schematic sectional view illustrating the sheet conveyance apparatus. FIG. 17 is a perspective view illustrating the bottom surface of the sheet conveyance apparatus according to the third exemplary embodiment.

As illustrated in FIGS. 15 and 16, the third exemplary embodiment differs from the second exemplary embodiment in that the rear cover 302 does not have the third restricting member 302*a* and that the sheet S is conveyed directly from the abutting rib 301*a* of the rear door 301 to the second restricting member 304. In the third exemplary embodiment, the upstream side portion 304*b* of the second restricting member 304 is extended to the area of the rear cover 302.

Therefore, according to the third exemplary embodiment, the sheet S can be delivered to the second restricting member 304 directly from the abutting rib 301*a* of the rear door 301, making it possible to reduce the risk of jam occurrence compared to that in the second exemplary embodiment. As illustrated in FIG. 16, similar to the second exemplary embodiment, the position of the downstream side edge of the abutting rib 301*a* in the width direction is positioned on the outside of the position of the second abutting portion 304*a* of the second restricting member 304 in the width direction.

As illustrated in FIG. 15, the third exemplary embodiment differs from the second exemplary embodiment in that, in the vicinity of the area where the abutting rib 301*a* intersects with the perpendicular rib 301*b*, the inclined ribs 301*c*1, 301*c*2, and 301*c*3 are not provided and a large conveyance surface 301*d* is provided. As illustrated in FIG. 17, in the third exemplary embodiment, a plurality of lightening portions 301*e* is formed on the front side of the rear door 301 since the conveyance surface 301*d* is large. Further, a plurality of label pasting ribs 301*g* is formed between a plurality of the lightening portions 301*e*. This enables stably pasting a label.

According to the third exemplary embodiment, it is possible to reduce the risk of the sheet S being caught by the perpendicular rib 301*b* while maintaining the strength by configuring the entire vicinity of the area where the abutting rib 301*a* intersects with the perpendicular rib 301*b* by a conveyance surface 304*d*.

Although, in the descriptions of the second and the third exemplary embodiments, the sheet conveyance apparatus 20 is applied to the double-sided conveyance path 30, the exemplary embodiments are not limited thereto. For example, in the exemplary embodiments, the sheet conveyance apparatus 20 may be applied to the conveyance path between the feeding cassette 150 and the transfer unit.

Although, in the descriptions of the second and the third exemplary embodiments, the reversing roller pair (i.e., drive roller 202 and reversing roller 206) as the first conveyance unit obliquely conveys the sheet S, the exemplary embodiments are not limited thereto. For example, in the exemplary embodiments, another roller pair for obliquely conveying the sheet S may be provided between the reversing roller pair (i.e., drive roller 202 and reversing roller 206) and the second conveyance unit (i.e., second oblique conveyance roller 305 and second facing roller 306).

Although, in the descriptions of the second and the third exemplary embodiments, the outer diameter of the first roller 202*a* of the drive roller 202 is made larger than the outer diameter of the second roller 202*b* of the drive roller 202 to enable obliquely conveying the sheet S, the exemplary embodiments are not limited thereto. For example, in the present exemplary embodiment, the sheet S may be obliquely conveyed by obliquely disposing the reversing rollers 206 with respect to the drive roller 202.

Although, in the descriptions of the second and the third exemplary embodiments, the drive roller 202 has both functions of discharging the sheet S and of reversing the sheet S, the exemplary embodiments are not limited thereto. For example, in the present exemplary embodiment, roller pairs for discharging the sheet S and roller pairs of reversing the sheet S may be separately provided.

Although, in the descriptions of the second and third exemplary embodiments, the abutting rib 301*a* and the first abutting portion 301*aa* are entirely inclined so as to extent inward in the width direction from the upstream to the downstream sides in the sheet conveyance direction, the exemplary embodiments are not limited thereto. For example, in the exemplary embodiments, a part of the abutting rib 301*a* may have the first abutting portion 301*aa* which is inclined to extend inward in the width direction from the upstream to the downstream sides in the sheet conveyance direction.

Although, in the descriptions of the second and the third exemplary embodiments, the position of the second abutting portion 304*a* is used as a reference for forming an image on the second surface of the sheet S, the exemplary embodiments are not limited thereto. For example, in the exemplary embodiments, after a side end of the sheet S is abutted on the second abutting portion 304*a* and the sheet S is further moved in the width direction, an image is formed on the sheet S.

Although, in the descriptions of the second and the third exemplary embodiments, the image forming apparatus 100 for forming an image on the sheet S includes the sheet conveyance apparatus 20, the exemplary embodiments are not limited thereto. For example, the exemplary embodiments may be applied to a sheet feeding apparatus for feeding the sheet S, and a processing apparatus for performing processing such as stapling on the sheet S.

Although, in the second and the third exemplary embodiments, an electrophotographic image forming process using a transfer unit and a fixing device as an image forming unit for forming an image on the sheet S is employed, the exemplary embodiments are not limited thereto. For example, in the exemplary embodiments, an ink-jet image forming process for forming an image on the sheet S by discharging ink liquid from a nozzle may be used as an image forming unit for forming an image on the sheet S.

Generally, in the image forming apparatuses such as copying machines, printers, and facsimiles, some of them are known to be provided with a double-sided conveyance path for guiding the sheet S with an image formed on the first surface by a transfer unit to the transfer unit again to enable forming an image on both surfaces of the sheet S. Conventional image forming apparatuses are known to convey the sheet S in a double-sided conveyance path while contacting an end of the sheet in the width direction to a reference plate by a horizontal register correction roller and an oblique conveyance roller. The reference plate is provided integrally with a conveyance guide configuring a part of the double-sided conveyance path, and the sheet is conveyed along with the reference plate, achieving skew correction.

Figure 19:
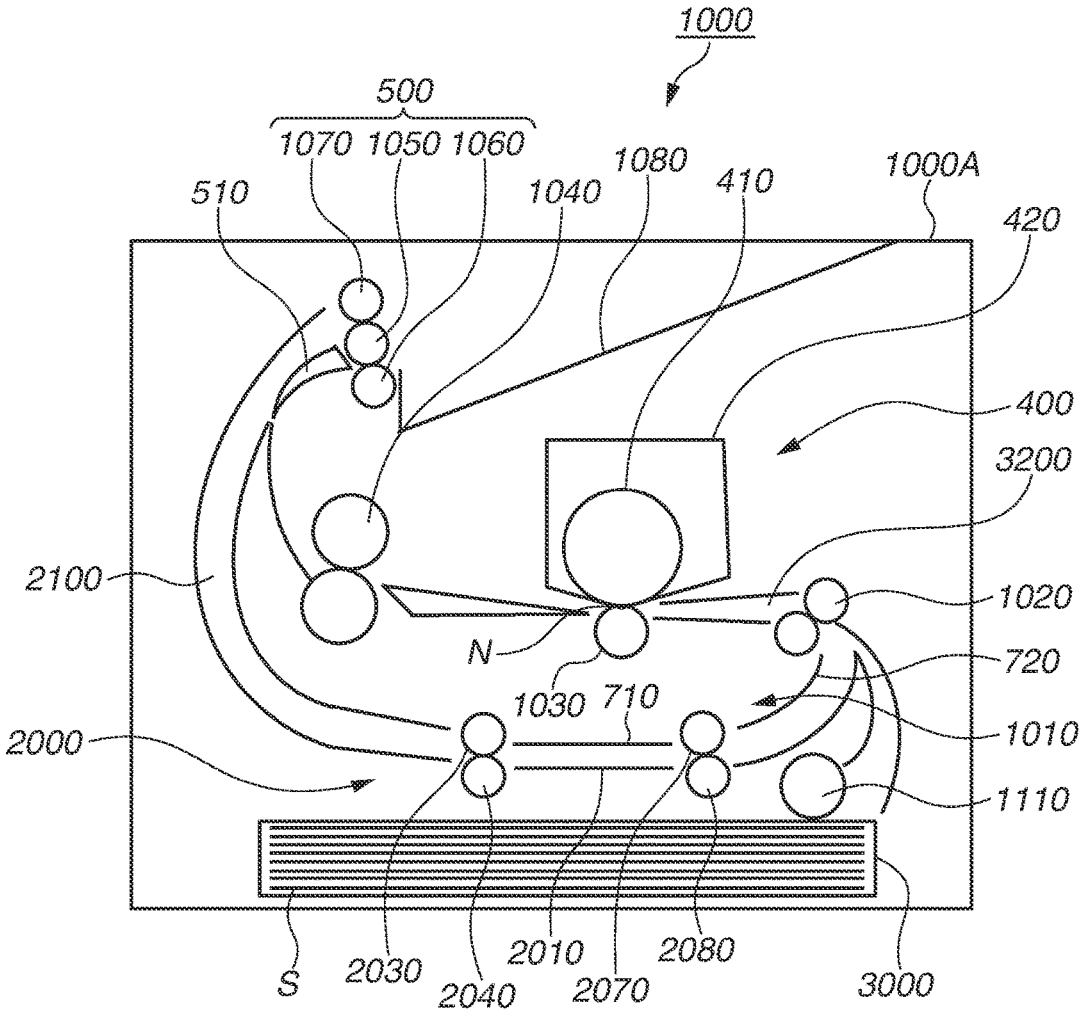
FIG. 19 is a schematic sectional view illustrating an overall configuration of a printer according to the third exemplary embodiment.

However, since there are various components between a reference plate and a transfer nip portion at which an image is transferred onto the sheet S, there has been a problem in the positioning accuracy between the reference plate and the transfer nip portion. If the sheet S is jammed in the double-sided conveyance guide, the above-described conveyance lower guide is opened or closed, or removed. Since the reference plate is integrally formed with the conveyance lower guide, a position shift may possibly occur each time jam treatment is made. A fourth exemplary embodiment for solving the above-described problem will be described below. A printer 1000 (image forming apparatus) according to the fourth exemplary embodiment is an electrophotographic laser beam printer. As illustrated in FIG. 19, the printer 1000 includes a cassette 3000 (stacking unit) which can be attached to and pulled out from a printer body 1000A, and an image forming unit 400 for forming an image on the sheet S. The printer 1000 includes a fixing roller pair 1040 for fixing the image onto the sheet, a discharge triplet roller 500 for discharging the sheet onto a discharge tray 1080, and a double-sided conveyance unit 2000 for forming an image on both surfaces of the sheet.

The image forming unit 400 includes a laser scanner (not illustrated), a process cartridge 420 (image bearing member unit) including a photosensitive drum 410 (image bearing member), and a transfer roller 1030 (transfer member). The process cartridge 420 is configured to be attachable to and detachable from the printer body 1000A.

When an image forming instruction is output to the printer 1000, the image forming unit 400 starts the image forming process based on image information input, for example, from an external computer connected to the printer 1000. The laser scanner (not illustrated) irradiates the photosensitive drum 410 with laser light based on the input image information. At this timing, the photosensitive drum 410 has been pre-charged by a charging roller (not illustrated), and an electrostatic latent image is formed on the photosensitive drum 410 by the irradiation with the laser light. Subsequently, a developing roller (not illustrated) included in the process cartridge 420 develops the electrostatic latent image to form a toner image on the photosensitive drum 410.

In parallel with the above-described image forming operation, the sheet S stacked on a cassette 3000 is separated and fed one by one by a feed roller 1110 and a separation pad (not illustrated). The fed sheet S is conveyed to a registration roller pair 1020. The registration roller pair 1020 forms a loop on the sheet S to correct skew, and, at a predetermined conveyance timing, conveys the sheet S toward a transfer nip portion N formed between the photosensitive drum 410 and the transfer roller 1030. When a transfer bias voltage is applied from the transfer roller 1030, the toner image formed on the photosensitive drum 410 is transferred onto the sheet S at the transfer nip portion N.

When the sheet S that has passed through the transfer nip portion N is heated and pressurized by the fixing roller pair 1040, the toner image is fixed on the sheet S. Then, the sheet S is discharged onto the discharge tray 1080 by a discharge triplet roller 500 (discharge unit). The discharge triplet roller 500 includes discharge rollers 1050 and 1060 and a double-sided roller 1070. When the sheet S is discharged onto the discharge tray 1080, the sheet S is guided to the discharge rollers 1050 and 1060 by a guide member 510. The sheet S is guided from the cassette 3000 to the discharge triplet roller 500 by a sheet conveyance path 3200.

When an image is formed on each of the surfaces of the sheet S, the sheet S with an image formed on the first surface is conveyed to the discharge roller 1050 and the double-sided roller 1070 by the rotatable guide member 510. Then, the sheet S is switch backed by the discharge roller 1050 and the double-sided roller 1070 and then conveyed in the double-sided conveyance path 2100. The sheet S conveyed in the double-sided conveyance path 2100 is conveyed again to the registration roller pair 1020 by the double-sided conveyance unit 2000, an image is formed on the second surface of the sheet S at the transfer nip portion N, and then the sheet S is discharged onto the discharge tray 1080.

A core frame 1010 (frame member) (described below) is provided above the double-sided conveyance unit 2000. The core frame 101 is a structural member composed of a first guide 710 and a second guide 720 configuring a part of the double-sided conveyance path 2100, and a third guide 730 (conveyance guide) configuring a part of the sheet conveyance path 3200. The core frame 1010 connects both side plates (not illustrated) of the printer 1000 formed in the near and the far directions of the paper surface illustrated in FIG.

1, and positions and holds the process cartridge 420. The core frame 1010 further rotatably supports (holds) the transfer roller 1030.

Figure 20:
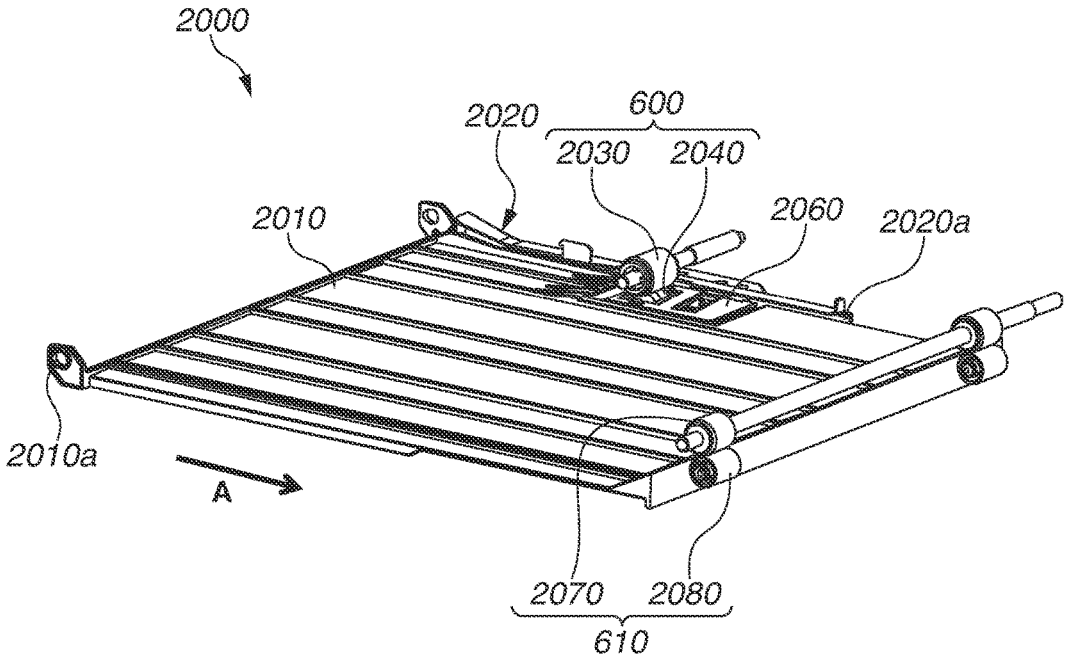
FIG. 20 is a perspective view illustrating a double-sided conveyance unit.

As illustrated in FIG. 20, the double-sided conveyance unit 2000 includes a double-sided conveyance guide 2010 configuring a part of the double-sided conveyance path 2100, a restricting member 2020 attached to the double-sided conveyance guide 2010, a skew correction roller pair 600, a double-sided conveyance roller pair 610, and an oblique conveyance roller guide 2060. The double-sided conveyance guide 2010 is configured to be rotatable with respect to a frame (not illustrated) or the core frame 1010 about a rotation fulcrum 2010*a*. The skew correction roller pair 600 (skew correction unit) includes an oblique conveyance roller 2030 (driving roller) driven by a driving source (not illustrated) and rotatably supported by the core frame 1010, and an oblique conveyance roller 2040 (driven roller) rotatable driven by the oblique conveyance roller 2030. The oblique conveyance roller 2040 is obliquely provided with respect to the oblique conveyance roller 2030. The skew correction roller pair 600 obliquely conveys the sheet S toward the restricting member 2020 (restricting unit). The double-sided conveyance roller pair 610 includes a re-feed roller 2070 driven by the above-described driving source and rotatably supported by the core frame 1010, and a re-feed roller 2080 rotatable driven by the re-feed roller 2070.

The sheet S that has been switch backed and conveyed by the discharge roller 1050 and the double-sided roller 1070 is further conveyed in the direction indicated by the arrow A, with a side end of the sheet S in the width direction being abutted on a reference surface 2020*a* (restricting surface) of the restricting member 2020 by the oblique conveyance rollers 2030 and 2040. Then, skew is corrected by being conveyed along the reference surface 2020*a*, and the sheet S is conveyed by the re-feed rollers 2070 and 2080 to the sheet conveyance path 3200.

Figure 21:
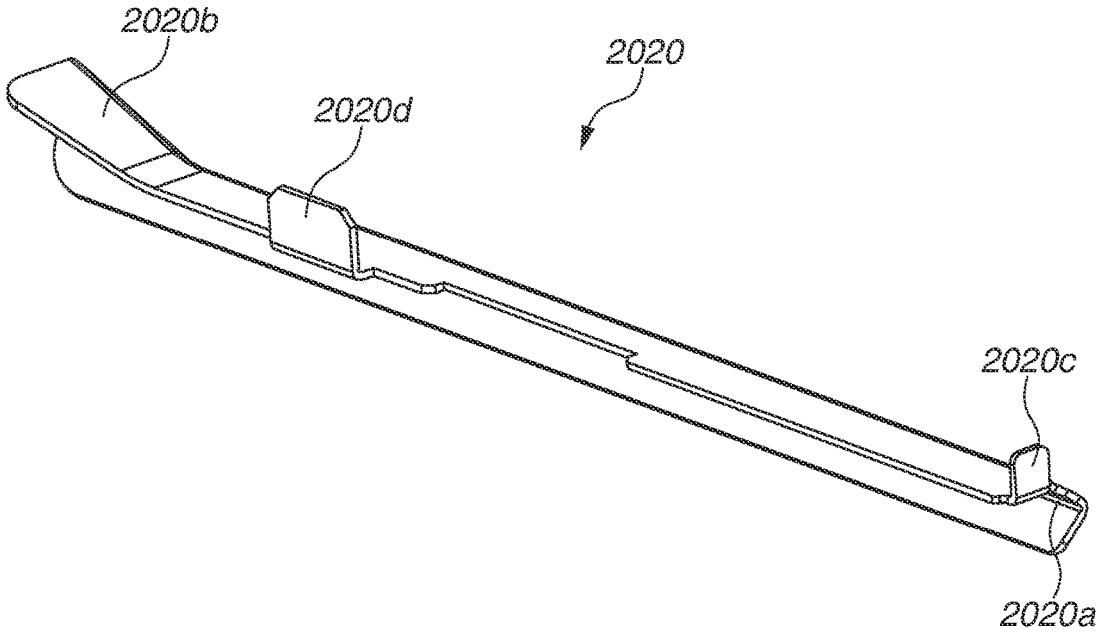
FIG. 21 is a perspective view illustrating a restricting member.

As illustrated in FIG. 21, the restricting member 2020 is made of a sheet plate, and the reference surface 2020*a* is formed in the inner side of a portion bent in a dogleg shape. A guiding portion 2020*b* for guiding the sheet S toward the reference surface 2020*a* is formed on the upstream side of the restricting member 2020 in the sheet conveyance direction. The restricting member 2020 includes a fitting portion 2020*c* (positioning portion) projecting upward, and an inserting portion 2020*d* (fixing portion).

Figure 22A:
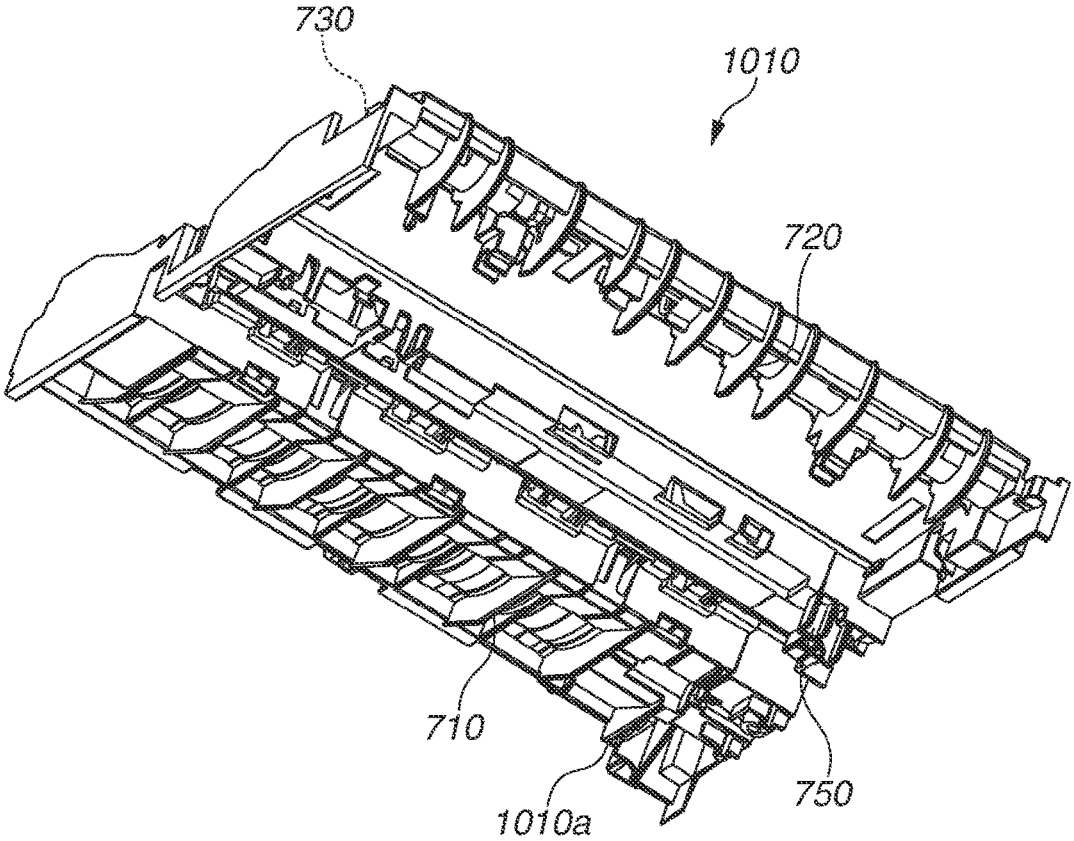
FIG. 22A is a perspective view illustrating a core frame.
Figure 22B:
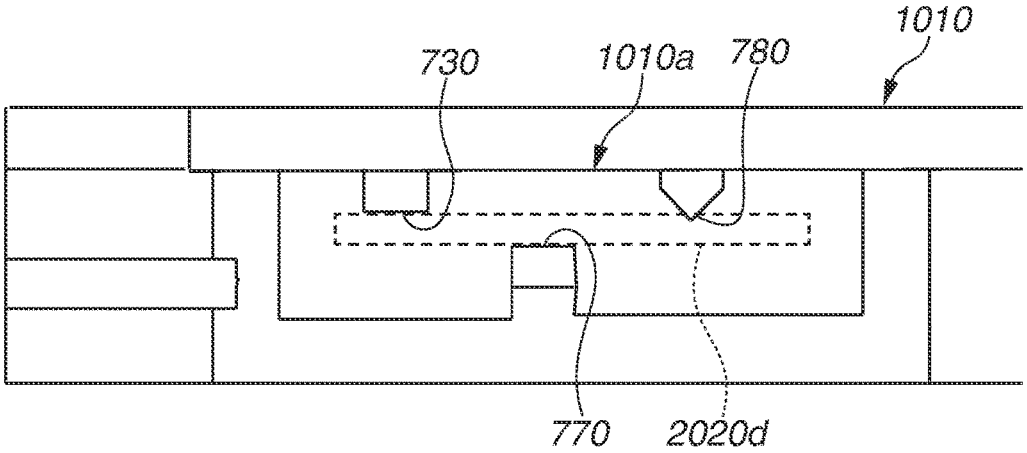
FIG. 22B is an enlarged view illustrating an attachment portion of the core frame.

As illustrated in FIG. 22A, the core frame 1010 includes a fitted portion 750 at which the side surface of the fitting portion 2020*c* is abutted and fitted, and an attachment portion 1010*a* in which the inserting portion 2020*d* is inserted. As illustrated in FIG. 22B, the attachment portion 1010*a* has three projecting portions 760, 770, and 780 alternately projecting in the width direction, and the inserting portion 2020*d* is pressed into the projecting portions 760, 770, and 780. More specifically, the restricting member 2020 is positioned when the fitting portion 2020*c* is abutted on the fitted portion 750, and fixed at high accuracy when the inserting portion 2020*d* is pressed into the attachment portion 1010*a*.

Figure 23:
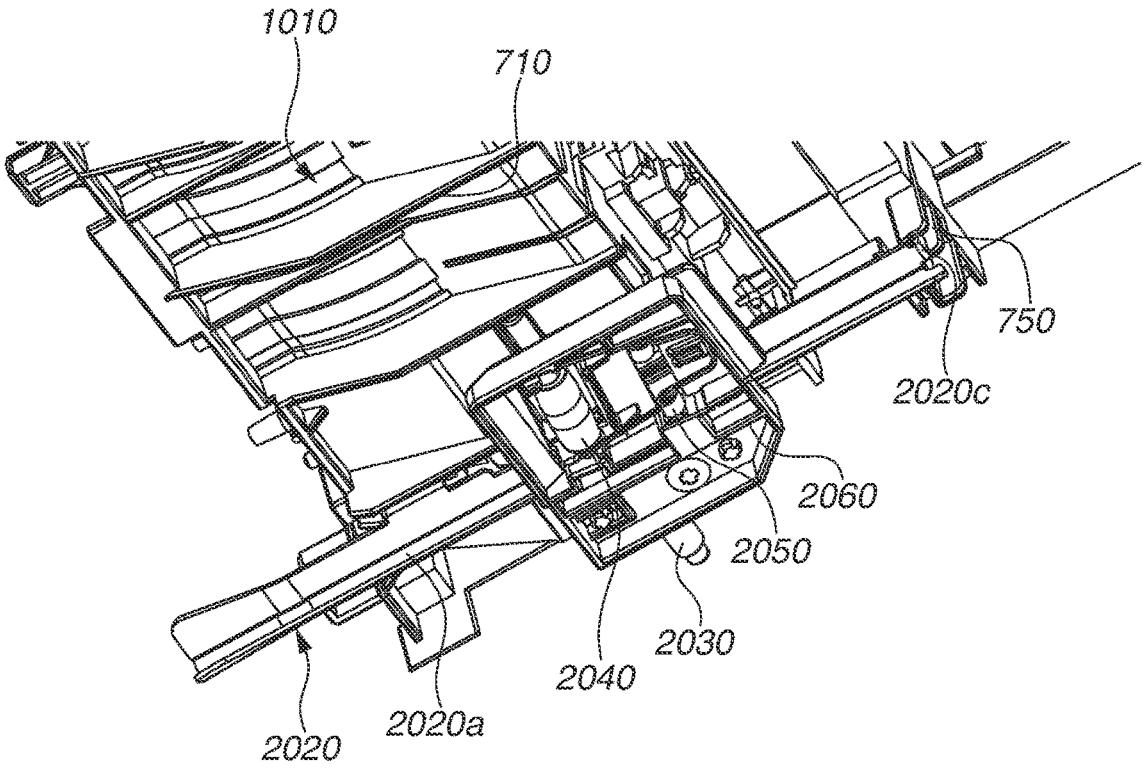
FIG. 23 is a perspective view illustrating the core frame, viewed from below.

As illustrated in FIG. 23, the oblique conveyance roller guide 2060 (holding unit) is formed in an approximately rectangular shape, and rotatably supports the oblique conveyance roller 2040. The oblique conveyance roller guide 2060 holds an oblique conveyance roller spring 2050 (urging unit) for urging the oblique conveyance roller 2040 onto the oblique conveyance roller 2030.

The oblique conveyance roller guide 2060 is configured to be attachable to the core frame 1010. In a state where the oblique conveyance roller guide 2060 is attached to the core frame 1010, the oblique conveyance roller guide 2060 is disposed approximately being flush with the double-sided conveyance guide 2010 and directly under the restricting member 2020. More specifically, when the oblique conveyance roller guide 2060 is attached to the core frame 1010, the restricting member 2020 does not drop off the core frame 1010.

Figure 24A:
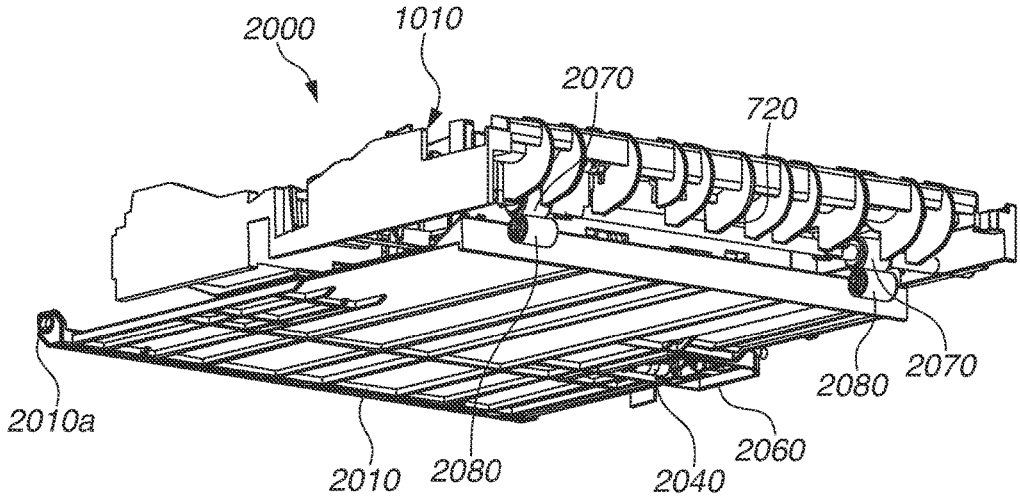
FIG. 24A is a perspective view illustrating the double-sided conveyance unit when a double-sided conveyance guide is closed.
Figure 24B:
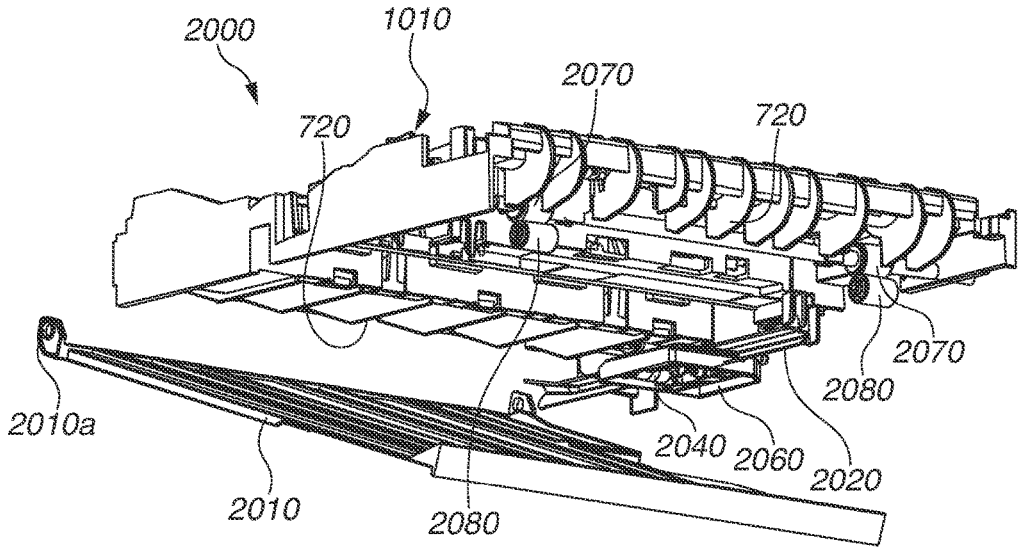
FIG. 24B is a perspective view illustrating the double-sided conveyance unit when the double-sided conveyance guide is open.

As described above, the double-sided conveyance guide 2010 is provided to be openable and closable by rotating about the rotation fulcrum 2010*a*. FIG. 24A illustrates a state where the double-sided conveyance guide 2010 is closed to allow the sheet S to be sent to the double-sided conveyance path 2100. When the sheet S is jammed in the double-sided conveyance path 2100, a user opens the double-sided conveyance guide 2010 downward, as illustrated in FIG. 24B. The restricting member 2020 and the oblique conveyance roller guide 2060 are configured not to interfere with the double-sided conveyance guide 2010 when the double-sided conveyance guide 2010 is opened downward.

More specifically, even when the user opens the double-sided conveyance guide 2010 downward for jam treatment, the restricting member 2020 and the oblique conveyance roller guide 2060 remain attached to the core frame 1010. Therefore, the positioning accuracy for the oblique conveyance rollers 2030 and 2040, and the restricting member 2020 is not affected even when the user performs jam treatment, making it possible to correct skew of the sheet S with high accuracy.

The core frame 1010 has the third guide 730 that is a part of the sheet conveyance path 3200 for guiding the sheet S to the transfer nip portion N. The restricting member 2020 and the oblique conveyance roller guide 2060 are positioned with respect to the core frame 1010. Therefore, the tolerance does not easily affect between the skew correction roller pair 600 and the reference surface 2020*a* of the restricting member 2020 and the transfer nip portion N, allowing image transfer onto the sheet S with favorable positional accuracy. Further, the core frame 1010 holds the process cartridge 420 and the transfer roller 1030, allowing image transfer onto the sheet S with more favorable positional accuracy.

Although, in the present exemplary embodiment, the core frame 1010 holds the process cartridge 420 and the transfer roller 1030, the present exemplary embodiment is not limited thereto. More specifically, the core frame 101 does not necessarily hold the process cartridge 420 and the transfer roller 1030, and may hold either the process cartridge 420 or the transfer roller 1030.

Although, in the present exemplary embodiment, the transfer bias voltage is applied to the transfer roller 1030 to transfer the toner image onto the sheet S, a belt may be provided instead of the transfer roller 1030. The target of the present exemplary embodiment is not limited to a monochrome laser beam printer, and may be applied to a full color laser beam printer and an ink-jet printer.

Although, in the present exemplary embodiment, an end of the sheet S is abutted on the reference surface 2020*a* of the restricting member 2020 by the skew correction roller pair 600, the present exemplary embodiment is not limited thereto. For example, the double-sided conveyance guide 2010 may be inclined so that the sheet S slides toward the reference surface 2000*a* to correct skew of the sheet S.

Figure 25A:
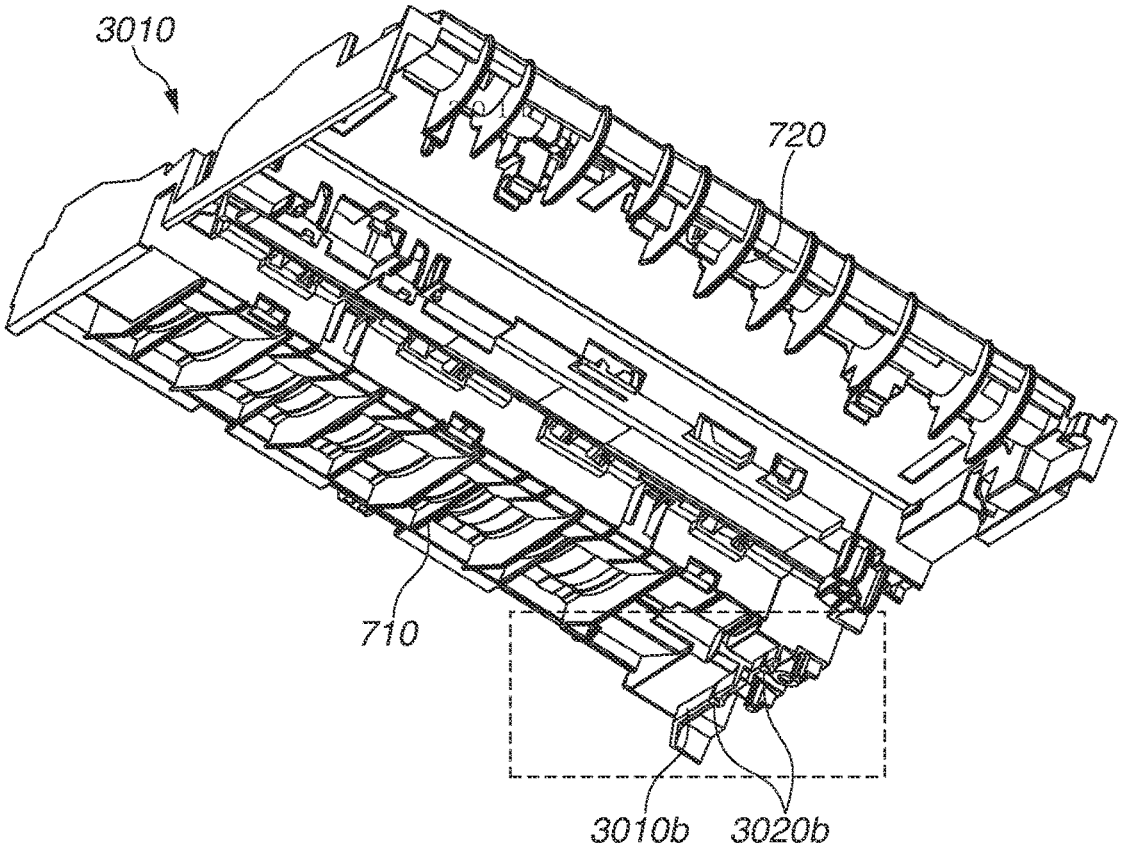
FIG. 25A is a perspective view illustrating a core frame according to a fourth exemplary embodiment.
Figure 25B:
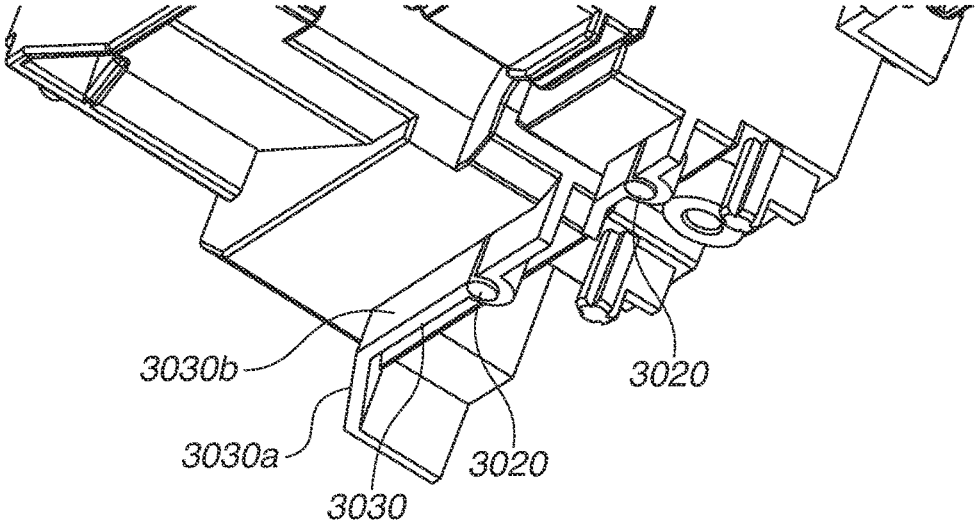
FIG. 25B is an enlarged perspective view of a dotted portion illustrated in FIG. 25A.

A fifth exemplary embodiment will be described below. The fifth exemplary embodiment differs from the fourth exemplary embodiment in that the restricting member is configured of parallel pins. In the present exemplary embodiment, elements identical to those in the fourth exemplary embodiment are assigned the same reference numerals, and redundant descriptions thereof will be omitted. As illustrated in FIGS. 25A and 25B, a core frame 3010 (frame member) has a restricting guide portion 3030 projecting below the first guide 710.

A plurality of metallic parallel pins 3020 (restricting members) is fixed to the restricting guide portion 3030 by insert molding (in the present exemplary embodiment, two parallel pins are fixed thereto). The restricting guide portion 3030 has a guiding surface 3030*a* for guiding the sheet S to the parallel pins 3020, and a restricting surface 303*b* successively formed with the guiding surface 303*a*, extending in parallel with the sheet conveyance direction (in the direction indicated by the arrow A illustrated in FIG. 20).

Parts of circumferential surfaces of the parallel pins 3020 project from the restricting surface 3030*b* toward the inside of the double-sided conveyance path 2100. Therefore, the sheet S (obliquely) conveyed by the skew correction roller pair 600 is mainly abutted on the parallel pins 3020 to correct skew of the sheet S. The metallic parallel pins 3020 provide high durability to enable reducing the frequency of parts replacement.

The parallel pins 3020 are fixed and positioned to the restricting guide portion 3030 of the core frame 3010 by insert molding. Therefore, the tolerance does not easily affect between the parallel pins 3020 and the transfer nip portion N, allowing image transfer onto the sheet S with favorable positional accuracy.

Although, in the present exemplary embodiment, the two parallel pins 3020 are provided, three or more parallel pins 3020 may be provided.

A sixth exemplary embodiment will be described below. The present exemplary embodiment differs from the fourth exemplary embodiment in that the restricting member includes parallel pins fixed to the oblique conveyance roller guide 2060. In the present exemplary embodiment, elements identical to those in the fourth and the fifth exemplary embodiments are assigned the same reference numerals, and redundant descriptions thereof will be omitted.

Figure 26:
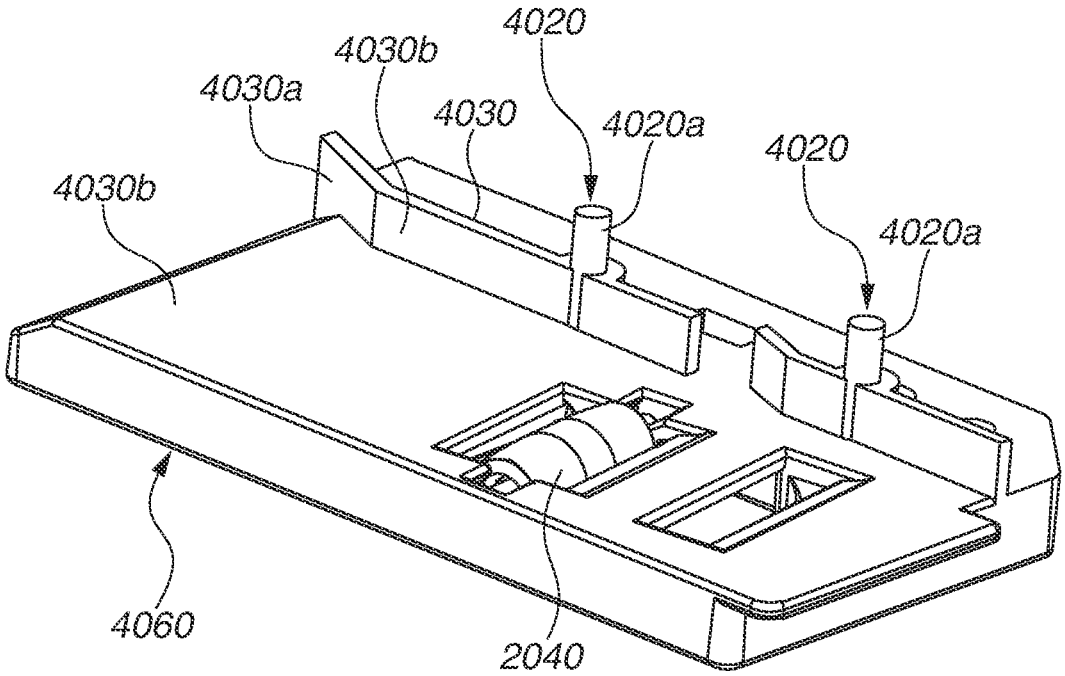
FIG. 26 is a perspective view illustrating an oblique conveyance roller guide according to a fifth exemplary embodiment.

As illustrated in FIG. 26, the oblique conveyance roller guide 4060 (holding unit) has a guide surface 4060*b* for guiding the conveyed sheet, and a restricting guide portion 4030 extending upward from the guide surface 4060*b*. A plurality of metallic parallel pins 4020 (restricting members) is fixed to the restricting guide portion 4030 by insert molding (in the present exemplary embodiment, two parallel pins are fixed thereto). The restricting guide portion 4030 has a guiding surface 4030*a* for guiding the sheet S to the parallel pins 4020, and a restricting surface 4030*b* successively formed with the guiding surface 4030*a*, extending in parallel with the sheet conveyance direction (in the direction indicated by the arrow A illustrated in FIG. 20).

Upper portions 4020*a* of the parallel pins 4020 are formed projecting upward from the restricting guide portion 4030. The oblique conveyance roller guide 4060 is positioned when the upper portions 4020*a* of the parallel pins 4020 are inserted into positioning holes (not illustrated) on the core frame 1010.

Parts of circumferential surfaces of the parallel pins 4020 project from the restricting surface 4030*b* toward the inside of the double-sided conveyance path 2100. Therefore, the sheet S (obliquely) conveyed by the skew correction roller pair 600 is mainly abutted on the parallel pins 4020 to correct skew of the sheet S.

As the present exemplary embodiment is thus configured, it is possible to easily position the parallel pins 4020 as restricting units with respect to the core frame 1010 by attaching the oblique conveyance roller guide 4060 to the core frame 1010.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-080458, filed Apr. 9, 2015, and No. 2015-124152, filed Jun. 19, 2015, and No. 2015-124263, filed Jun. 19, 2015, and No. 2015-124264, filed Jun. 19, 2015, which are hereby incorporated by reference herein in their entirety.

What is claimed is:

1. An image forming apparatus for forming an image on a sheet, the image forming apparatus comprising:

an image forming unit configured to form the image on the sheet;

a double-sided conveyance path through which the sheet with the image formed on a first surface passes before the image forming unit forms an image on a second surface opposite to the first surface;

a guide member having a contact portion configured to contact one end of the sheet in a width direction of the sheet, wherein the guide member is provided on the double-sided conveyance path; and a reversing roller unit forwardly and reversely rotatable and configured to convey the sheet to the double-sided conveyance path during a reverse rotation, wherein the reversing roller unit includes a drive shaft, and a first roller and a second roller coaxially disposed on, and rotatable with, the drive shaft, wherein the second roller is disposed at a position farther away from the contact portion than the first roller in an axial direction of the drive shaft, and wherein the second roller has an outer diameter that is larger than an outer diameter of the first roller.

2. The image forming apparatus according to claim 1, further comprising a conveyance roller pair configured to convey the sheet toward the image forming unit on the double-sided conveyance path, wherein the conveyance roller pair is disposed on a downstream side of the reversing roller unit in a conveyance direction of the sheet.

3. The image forming apparatus according to claim 1, wherein the conveyance roller pair is configured to obliquely convey the sheet in a direction such that the one end of the sheet becomes closer to the contact portion.

4. The image forming apparatus according to claim 1, further comprising a fixing unit including a fixing nip portion and configured to heat the sheet with the image formed thereon to fix the image onto the sheet at the fixing nip portion while conveying the sheet, wherein the fixing unit is disposed between the image forming unit and the reversing roller unit in a conveyance direction of the sheet, and wherein a distance over which the sheet is conveyed by the forward rotation of the reversing roller unit after a trailing edge of the sheet passes through the fixing nip portion is shorter than a distance over which the sheet is conveyed by the reverse rotation of the reversing roller unit.

5. The image forming apparatus according to claim 1, wherein a ratio of the outer diameter of the second roller to the outer diameter of the first roller is 1.005 or greater and 1.025 or below.

6. An image forming apparatus for forming an image on a sheet, the image forming apparatus comprising:

an image forming unit configured to form the image on the sheet;

a double-sided conveyance path through which the sheet with the image formed on a first surface passes toward the image forming unit to form an image on a second surface of the sheet opposite to the first surface;

a guide member having a contact portion configured to contact one end of the sheet in a width direction of the sheet, wherein the guide member is provided on the double-sided conveyance path;

a first roller unit forwardly and reversely rotatable, wherein the first roller unit includes a drive shaft, and a first roller and a second roller coaxially disposed on, and rotatable with, the drive shaft;

a second roller unit configured to form a first nip portion in cooperation with the first roller unit; and a third roller unit configured to form a second nip portion in cooperation with the first roller unit, wherein, while the first roller unit is forwardly rotating, the sheet is conveyed toward an outside of the image forming apparatus at the first nip portion and conveyed toward the double-sided conveyance path at the second nip portion, wherein the second roller is disposed at a position farther away from the contact portion than the first roller in an axial direction of the drive shaft, and wherein the second roller has an outer diameter that is larger than an outer diameter of the first roller.

7. The image forming apparatus according to claim 6, wherein the drive shaft is driven by a driving source to rotate the first roller unit, and each of the second and the third roller units rotates by the rotation of the first roller unit.

8. The image forming apparatus according to claim 6, further comprising a conveyance roller pair configured to convey the sheet toward the image forming unit on the double-sided conveyance path, wherein the conveyance roller pair is disposed on a downstream side of the first roller unit in a conveyance direction of the sheet.

9. The image forming apparatus according to claim 6, further comprising a fixing unit including a fixing nip portion and configured to heat the sheet with the image formed thereon to fix the image onto the sheet at the fixing nip portion while conveying the sheet, wherein the fixing unit is disposed between the image forming unit and the second nip portion in a conveyance direction of the sheet, and wherein a distance over which the sheet is conveyed by the forward rotation of the first roller unit at the second nip portion after a trailing edge of the sheet passes through the fixing nip portion is shorter than a distance over which the sheet is conveyed by the reverse rotation of the first roller unit at the second nip portion.

10. The image forming apparatus according to claim 8, wherein the conveyance roller pair is configured to obliquely convey the sheet in a direction such that the one end of the sheet becomes closer to the contact portion.

11. The image forming apparatus according to claim 6, wherein a ratio of the outer diameter of the second roller to the outer diameter of the first roller is 1.005 or greater and 1.025 or below.

* * * * *